US012702196B2

(12) United States Patent
Connell et al.

(10) Patent No.: US 12,702,196 B2
(45) Date of Patent: Aug. 11, 2026

(54) SOLE STRUCTURE FOR AN ARTICLE OF FOOTWEAR

(71) Applicant: NIKE, Inc., Beaverton, OR (US)

(72) Inventors: Jeremy L. Connell, Portland, OR (US); Craig Fredrick, Portland, OR (US); Jason R. Meeker, Portland, OR (US); Kort W. Neumann, IV, Portland, OR (US); Chris Wilburn, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/999,413

(22) Filed: Dec. 23, 2024

(65) Prior Publication Data

US 2025/0212996 A1 Jul. 3, 2025

Related U.S. Application Data

(60) Provisional application No. 63/616,536, filed on Dec. 30, 2023.

(51) Int. Cl.
*A43B 13/20* (2006.01)
*A43B 13/28* (2006.01)

(52) U.S. Cl.
CPC ..... *A43B 13/20* (2013.01); *A43B 13/28* (2013.01)

(58) Field of Classification Search
CPC ..... A43B 13/20; A43B 13/203; A43B 13/206
USPC ..... 36/29, 35 B
See application file for complete search history.

(56) References Cited

U.S. PATENT DOCUMENTS

| | | | | | |
|---|---|---|---|---|---|
| 5,406,719 | A * | 4/1995 | Potter | A43B 13/203 | 36/35 B |
| 5,625,964 | A * | 5/1997 | Lyden | A43B 13/20 | 36/114 |
| 5,878,510 | A * | 3/1999 | Schoesler | A43B 17/026 | 36/43 |
| 6,009,637 | A * | 1/2000 | Pavone | A43B 13/141 | 36/28 |
| 6,453,577 | B1 * | 9/2002 | Litchfield | A43B 13/203 | 36/35 B |
| 10,159,307 | B2 * | 12/2018 | Case | A43B 13/188 | |
| 11,039,662 | B2 * | 6/2021 | Taylor | A43B 13/20 | |
| 2006/0230636 | A1 * | 10/2006 | Kokstis | B29D 35/142 | 36/35 B |

(Continued)

OTHER PUBLICATIONS

European Patent Office (ISA), International Search Report and Written Opinion for PCT App. No. PCT/US2024/061866, mailed Apr. 1, 2025.

*Primary Examiner* — Ted Kavanaugh
(74) *Attorney, Agent, or Firm* — Honigman LLP; Matthew H. Szalach

(57) ABSTRACT

A sole structure for an article of footwear including an upper. The sole structure includes a midsole having a first surface opposing the upper, a second surface disposed on an opposite side of the midsole than the first surface, and an aperture formed through a thickness of the midsole and including a first opening at the first surface and a second opening at the second surface, a first fluid-filled chamber abutting the second surface of the midsole and extending over the aperture at the second opening, and a strobel attached to the upper and extending into the aperture at the first opening, the strobel opposing the first fluid-filled chamber at the aperture.

20 Claims, 16 Drawing Sheets

(56) References Cited

U.S. PATENT DOCUMENTS

| | | | | |
|---|---|---|---|---|
| 2014/0075779 | A1* | 3/2014 | Bruce | A43B 13/181 36/29 |
| 2015/0223564 | A1* | 8/2015 | Peyton | A43B 23/0255 36/28 |
| 2016/0021974 | A1* | 1/2016 | Schindler | A43B 13/223 12/146 B |
| 2017/0042286 | A1* | 2/2017 | Meschter | A43B 13/189 |
| 2019/0365038 | A1* | 12/2019 | Auyang | A43B 9/02 |
| 2019/0365039 | A1* | 12/2019 | Auyang | A43B 13/39 |
| 2019/0365040 | A1* | 12/2019 | Auyang | A43B 13/28 |
| 2020/0305549 | A1* | 10/2020 | Bailly | A43B 13/125 |
| 2021/0298419 | A1 | 9/2021 | Aslani et al. | |
| 2021/0368920 | A1* | 12/2021 | Elder | A43B 13/023 |
| 2022/0125160 | A1 | 4/2022 | Baza et al. | |
| 2023/0172308 | A1 | 6/2023 | Frank et al. | |
| 2023/0404210 | A1 | 12/2023 | Connell et al. | |

* cited by examiner

SOLE STRUCTURE FOR AN ARTICLE OF FOOTWEAR

CROSS REFERENCE TO RELATED APPLICATIONS

This application claims priority under 35 U.S.C. § 119(e) to U.S. Provisional Application No. 63/616,536, filed on Dec. 30, 2023. The disclosure of this prior application is considered part of the disclosure of this application and is hereby incorporated by reference in its entirety.

FIELD

The present disclosure relates generally to a sole structure and, more particularly, to a sole structure for an article of footwear.

BACKGROUND

This section provides background information related to the present disclosure and is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. For example, a sole structure may include a midsole and an outsole. The midsole is generally disposed between the outsole and the upper and provides cushioning for the foot. The midsole may include a pressurized fluid-filled chamber that compresses resiliently under an applied load to cushion the foot by attenuating ground-reaction forces. The outsole provides abrasion-resistance and traction with the ground surface and may be formed from rubber or other materials that impart durability and wear-resistance, as well as enhance traction with the ground surface.

While conventional sole structures provide a wearer with a degree of comfort and support during use, a continuous need exists to develop sole structures that provide targeted support and response for particular movements and activities.

DRAWINGS

The drawings described herein are for illustrative purposes only of selected configurations and not all possible implementations, and are not intended to limit the scope of the present disclosure.

Figure 1:
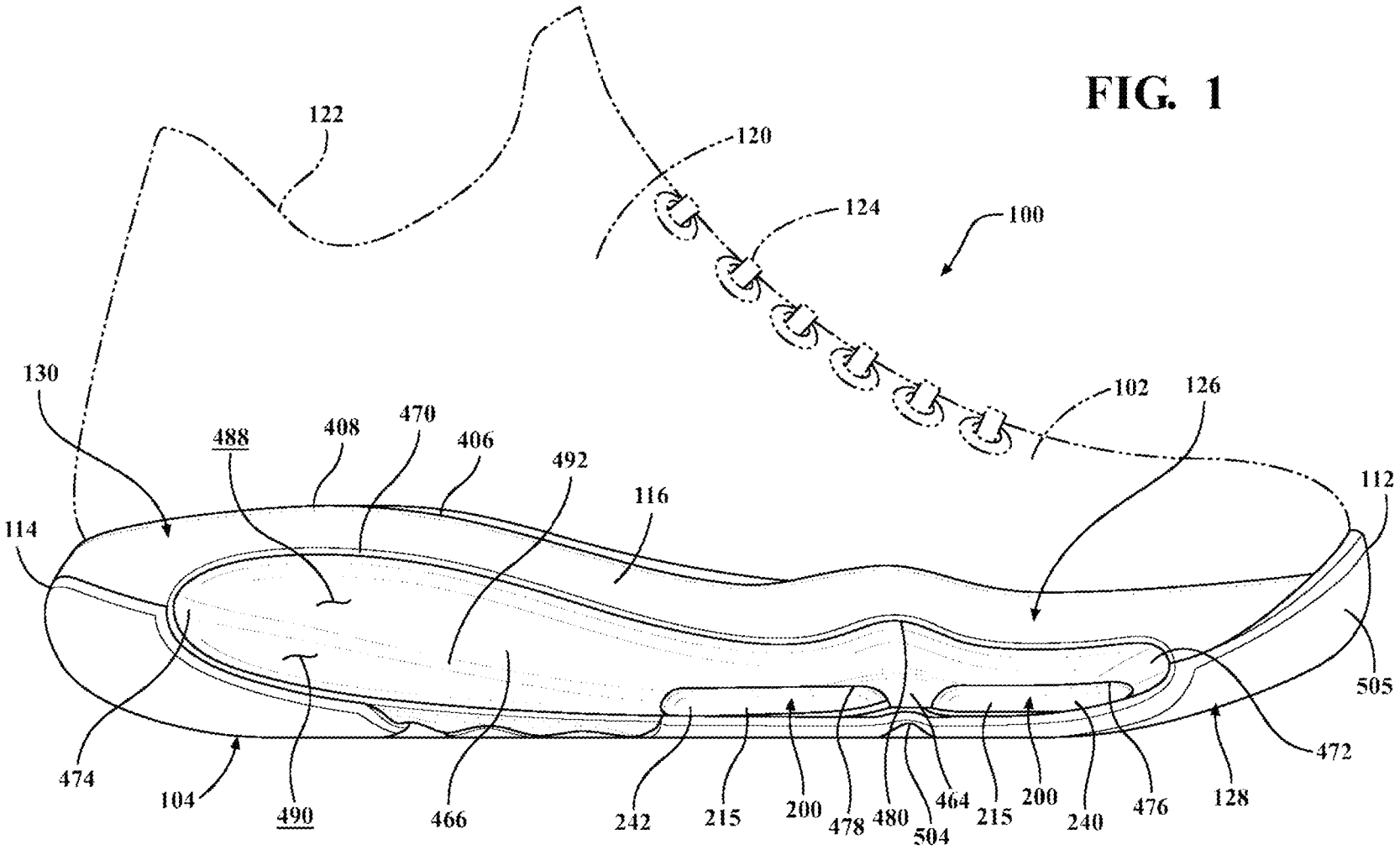
FIG. 1 is a lateral side view of an article of footwear incorporating a sole structure in accordance with principles of the present disclosure.
Figure 6:
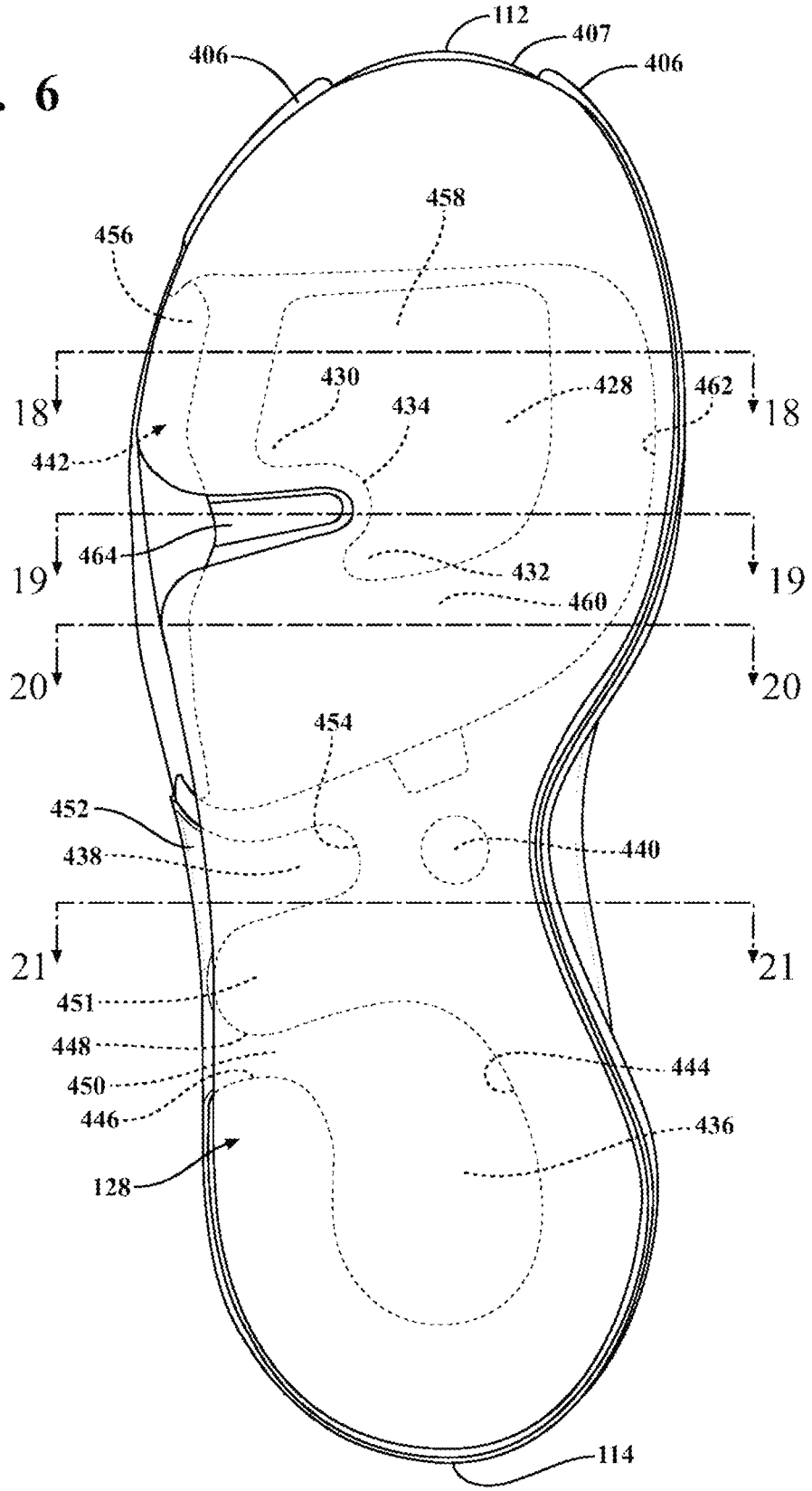
FIG. 6 is a bottom view of the sole structure of FIG. 1.
Figure 7:
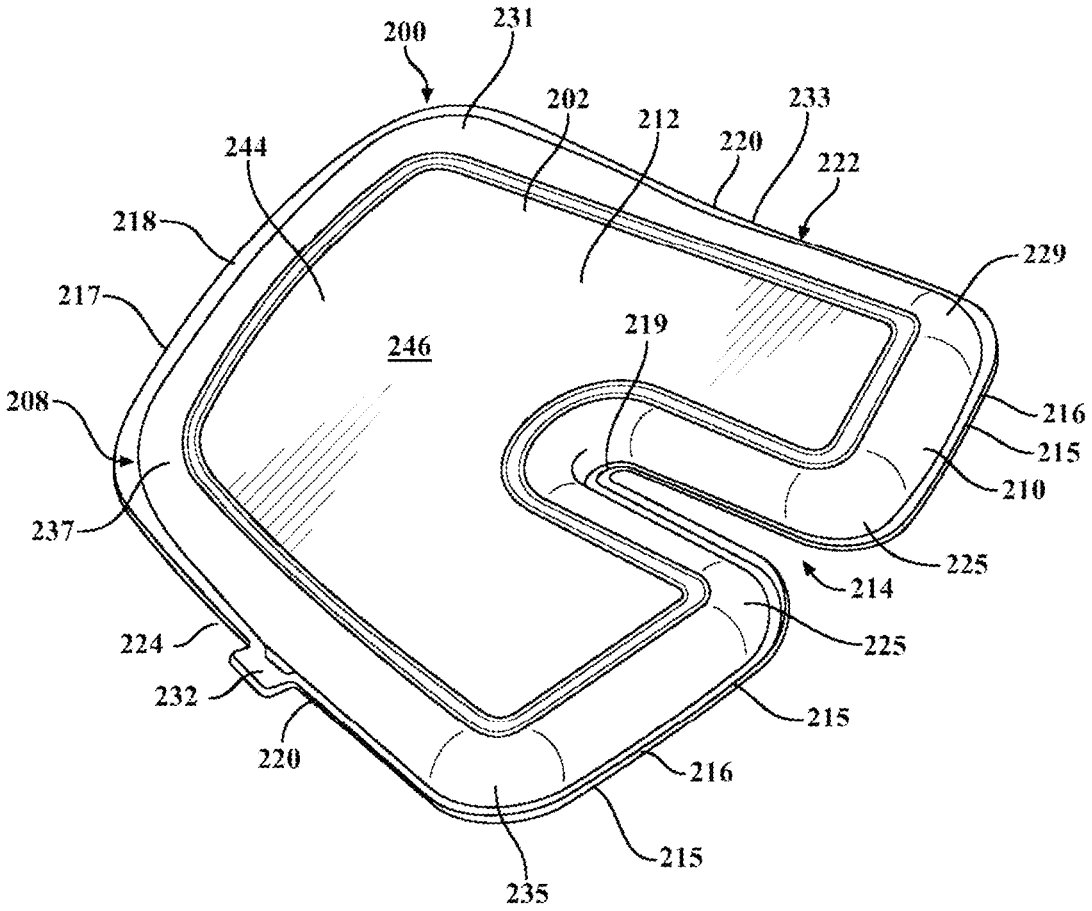
Figure 8:
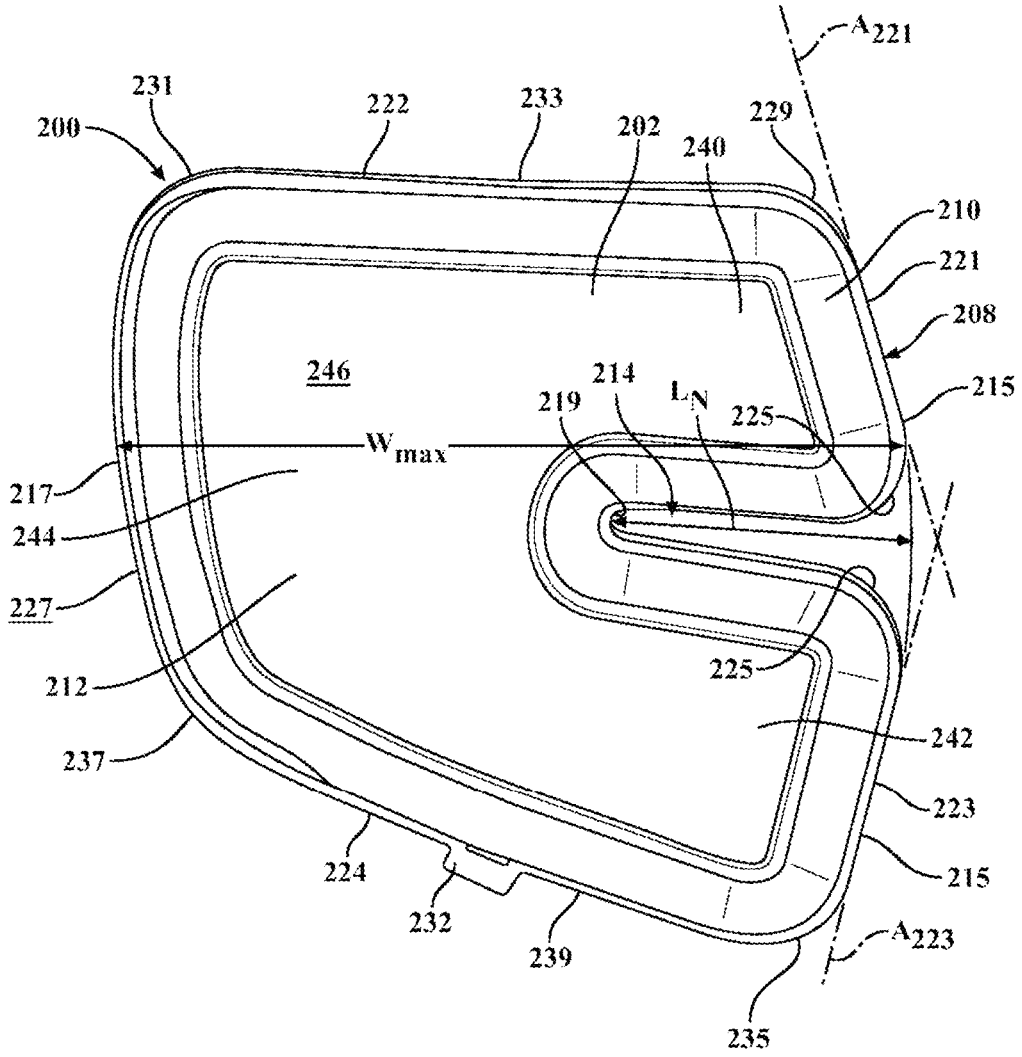
Figure 9:
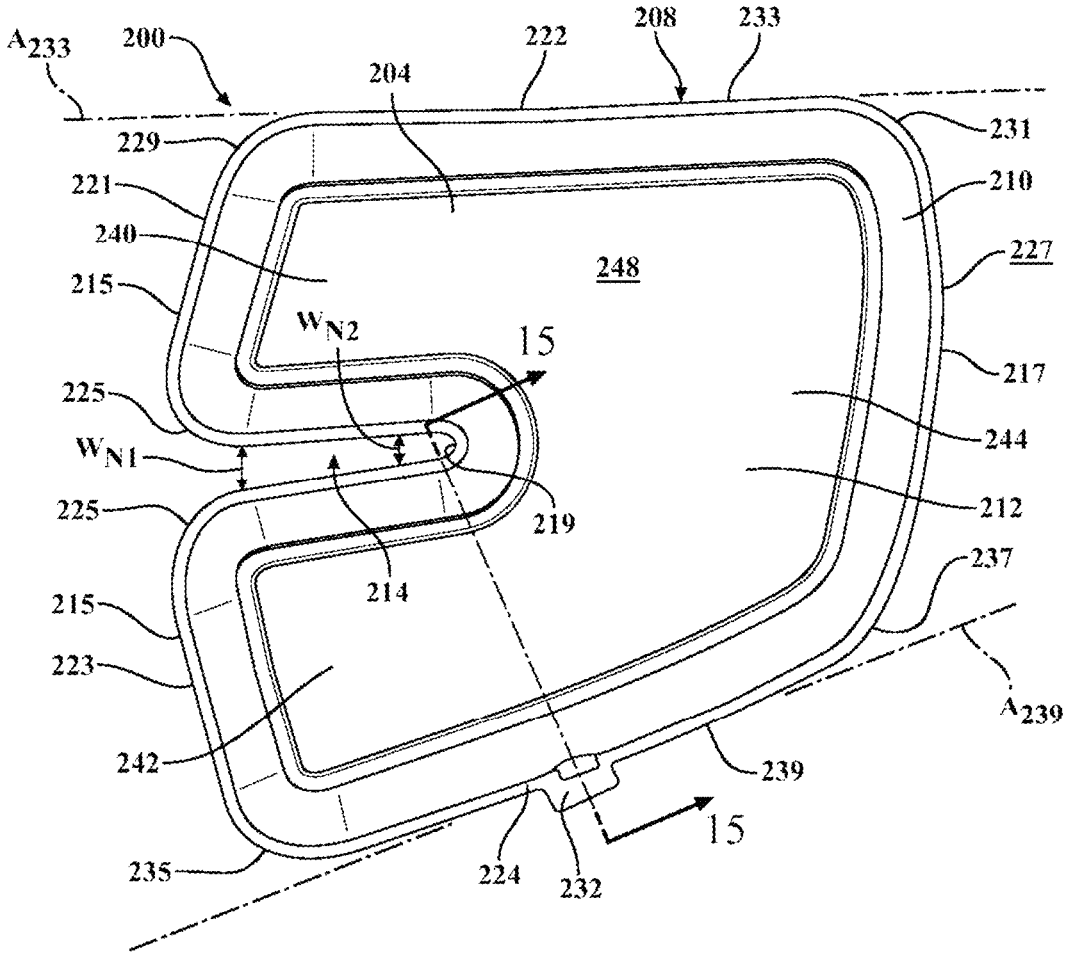
Figure 10:
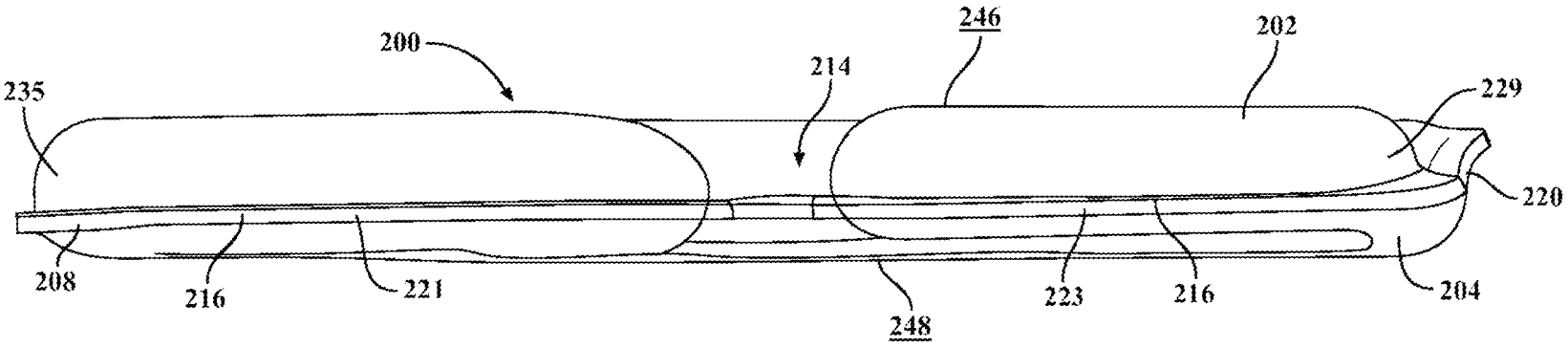
Figure 11:
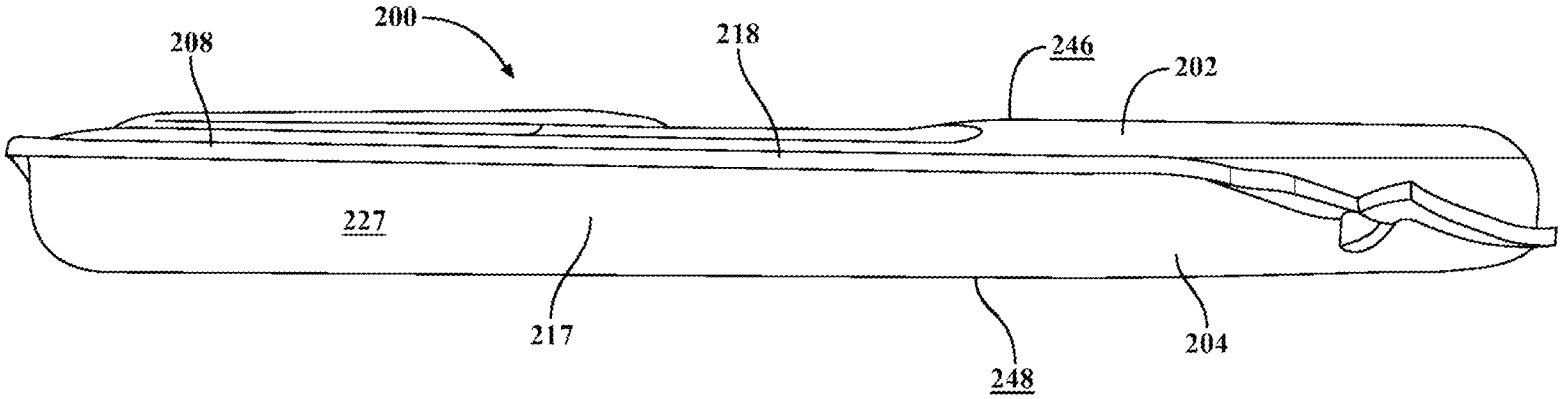
Figure 12:
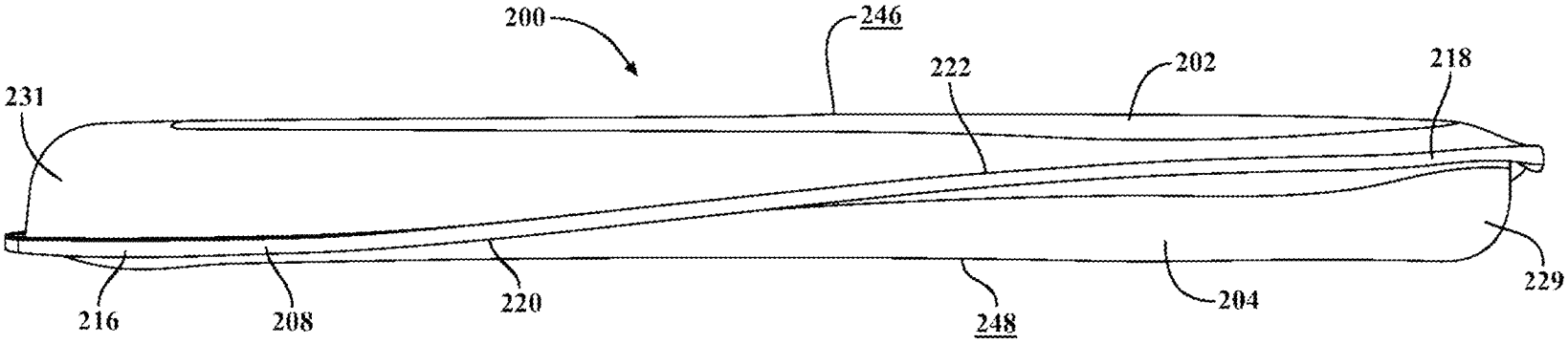
Figure 13:
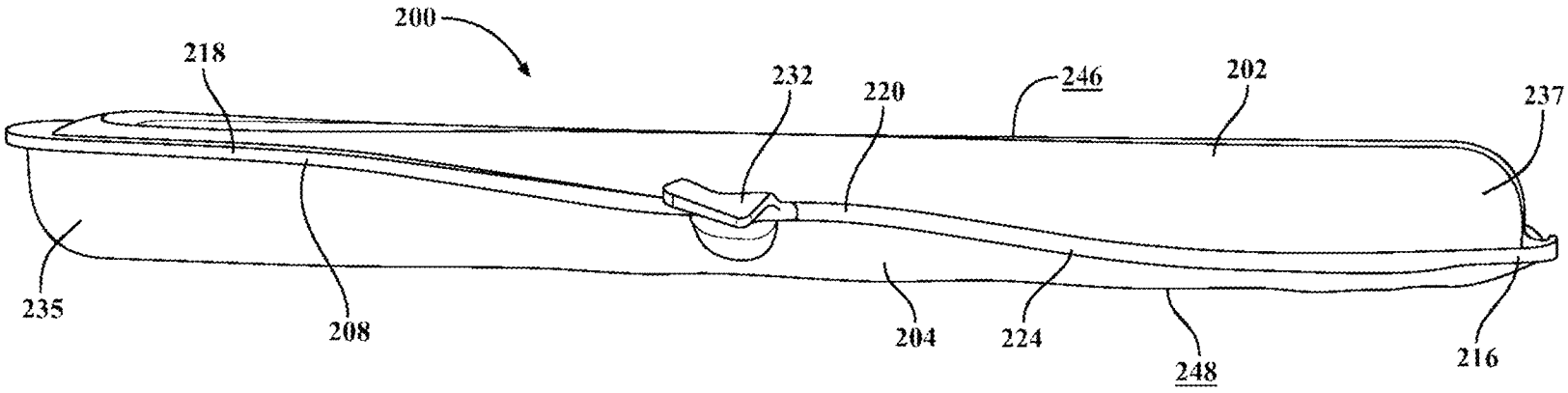
Figure 14:
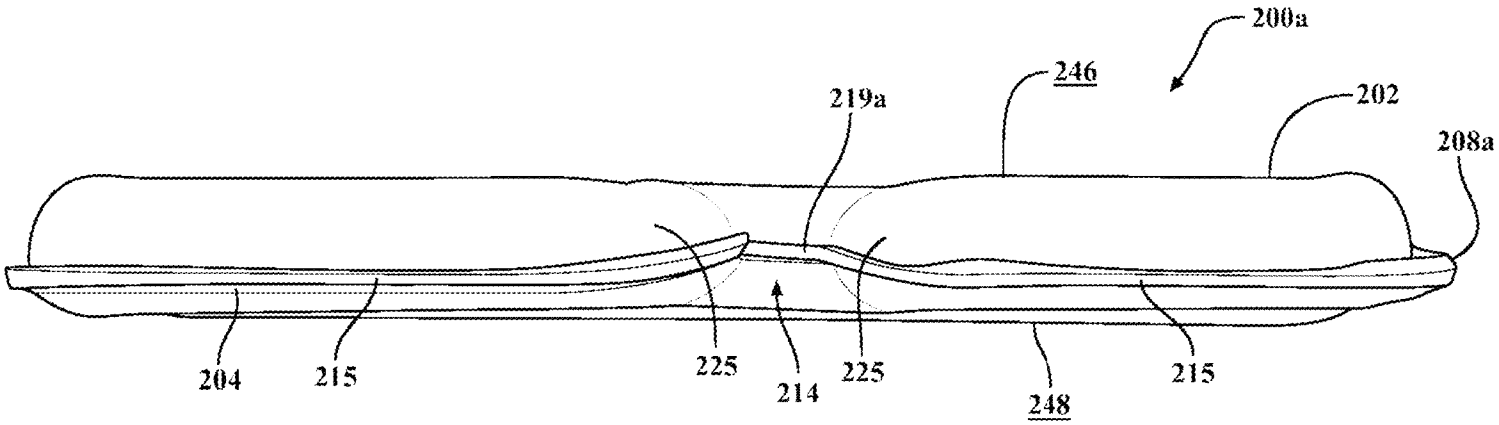
Figure 15:
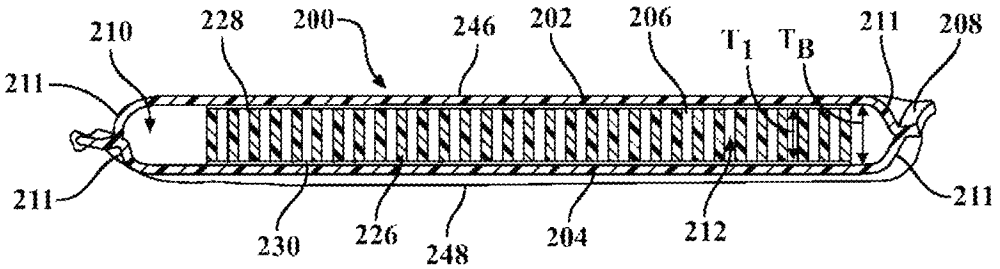
Figure 16:
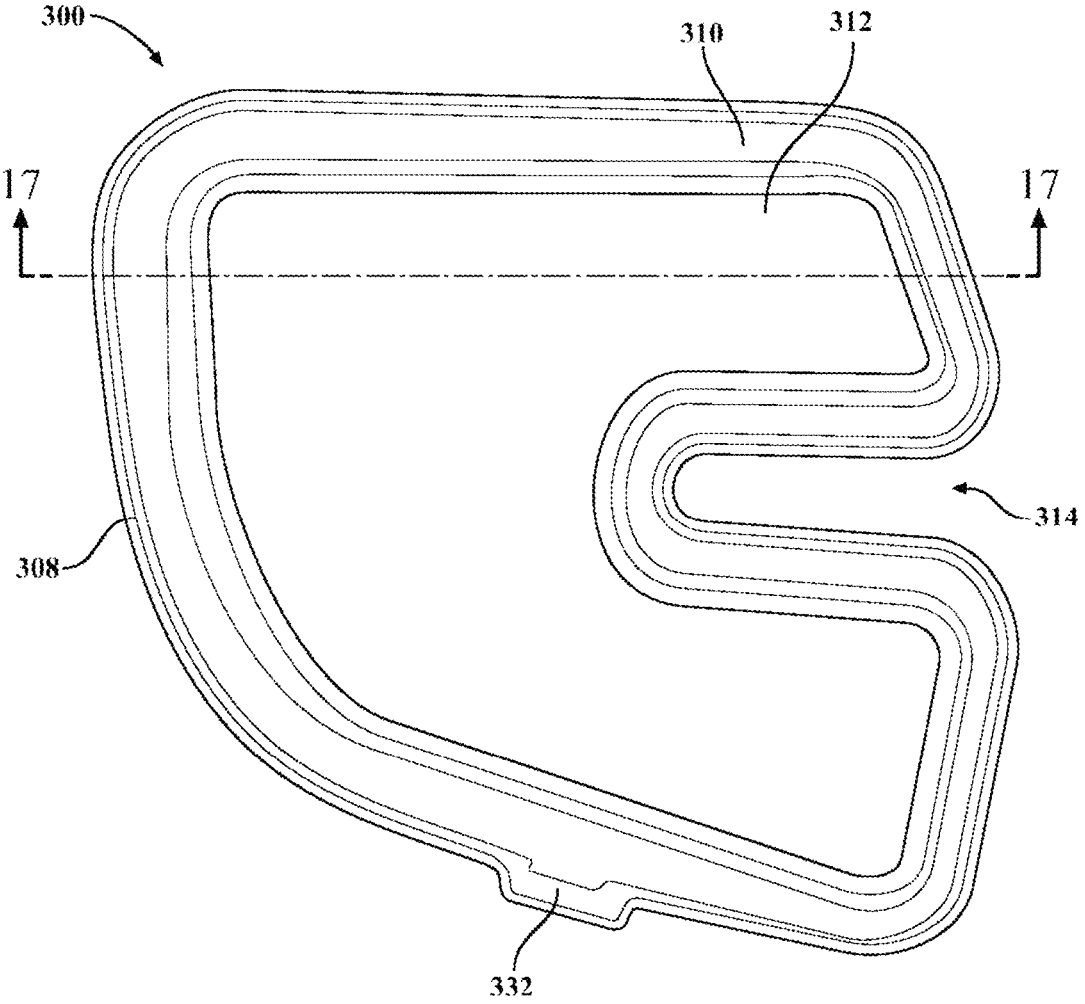
Figure 17:
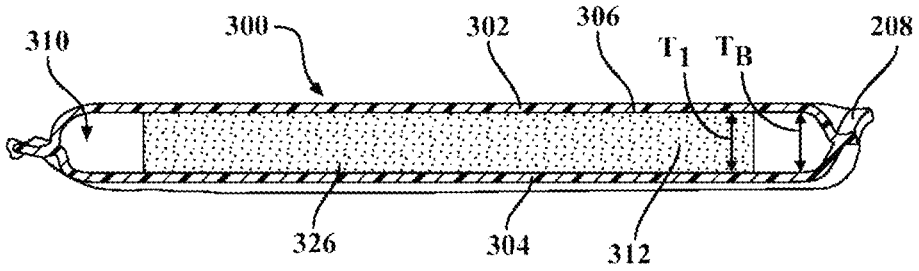
Figure 18:
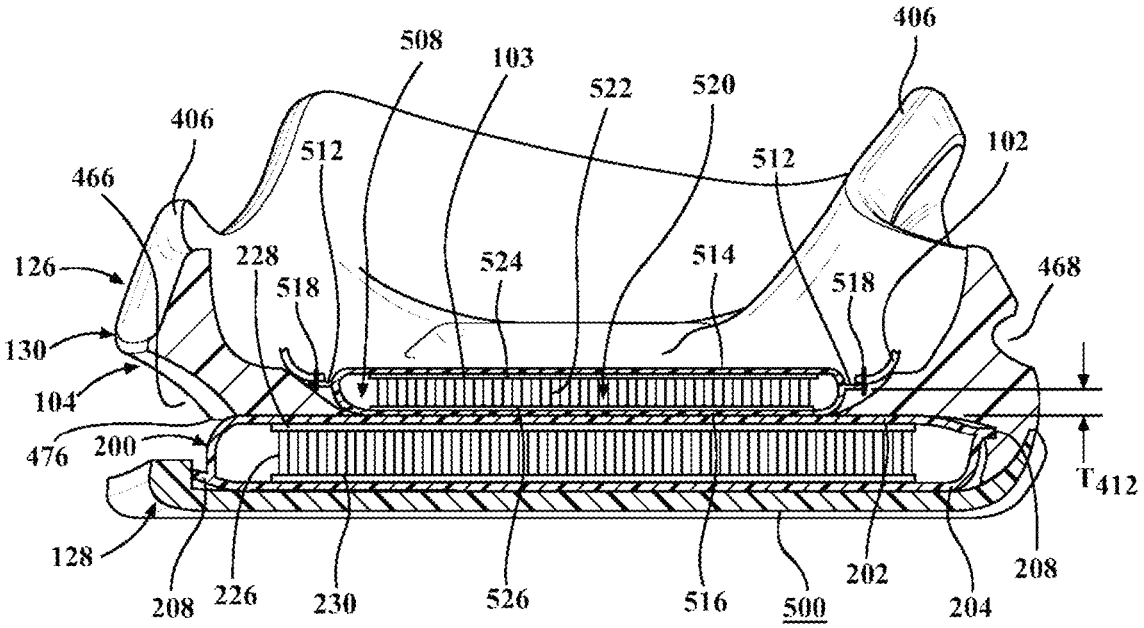
Figure 19:
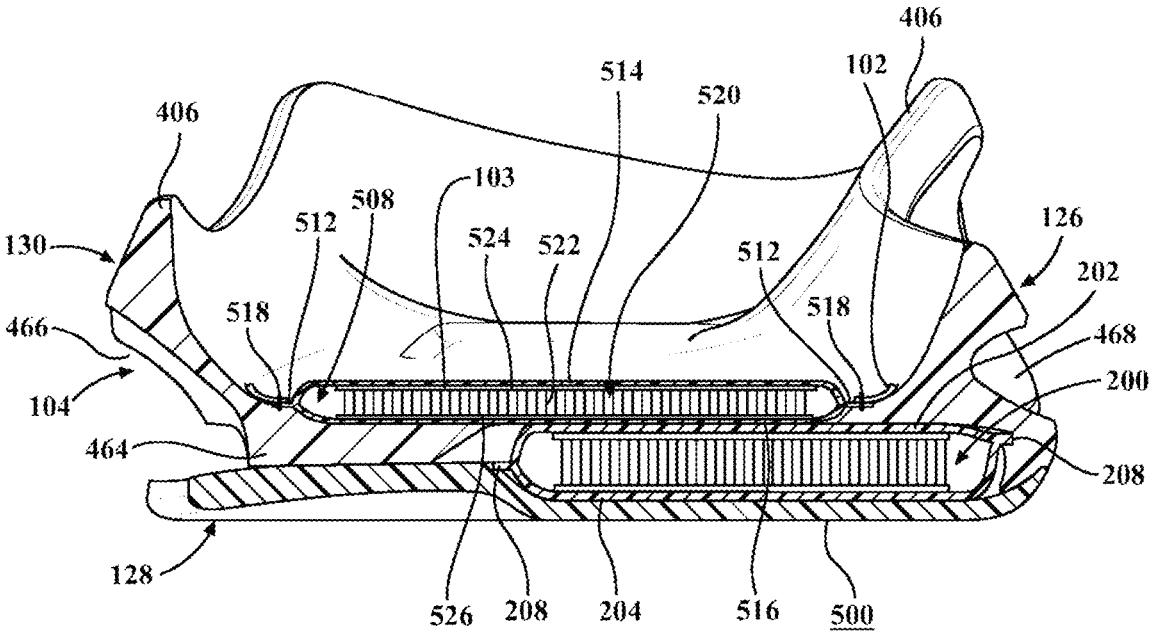
Figure 20:
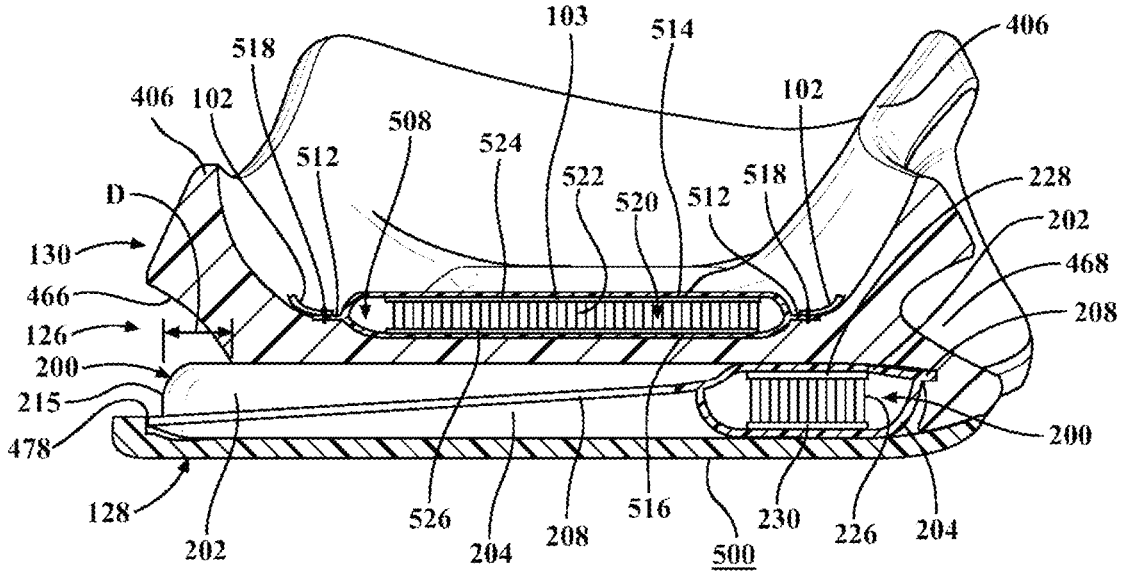
Figure 21:
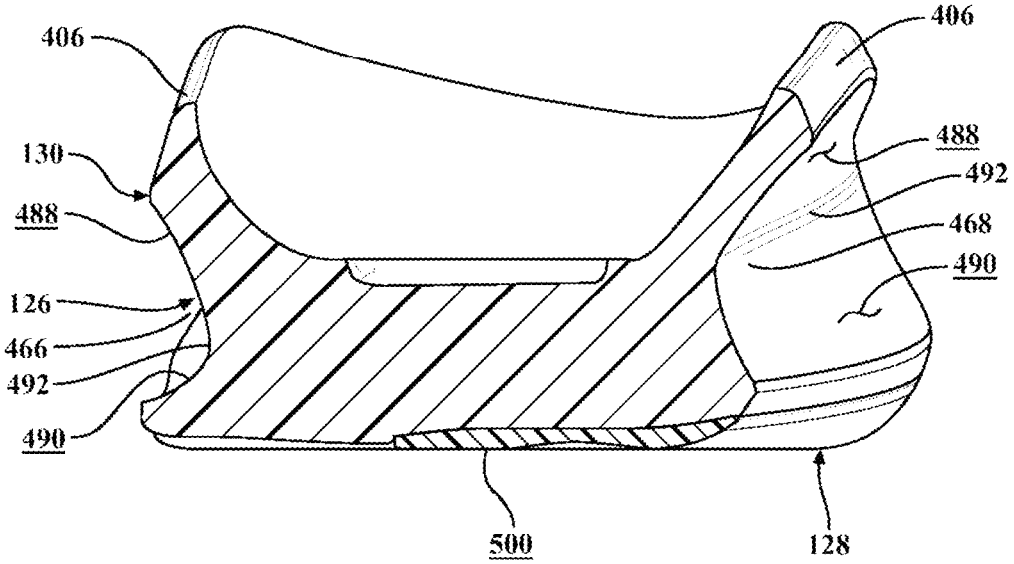
Figure 22:
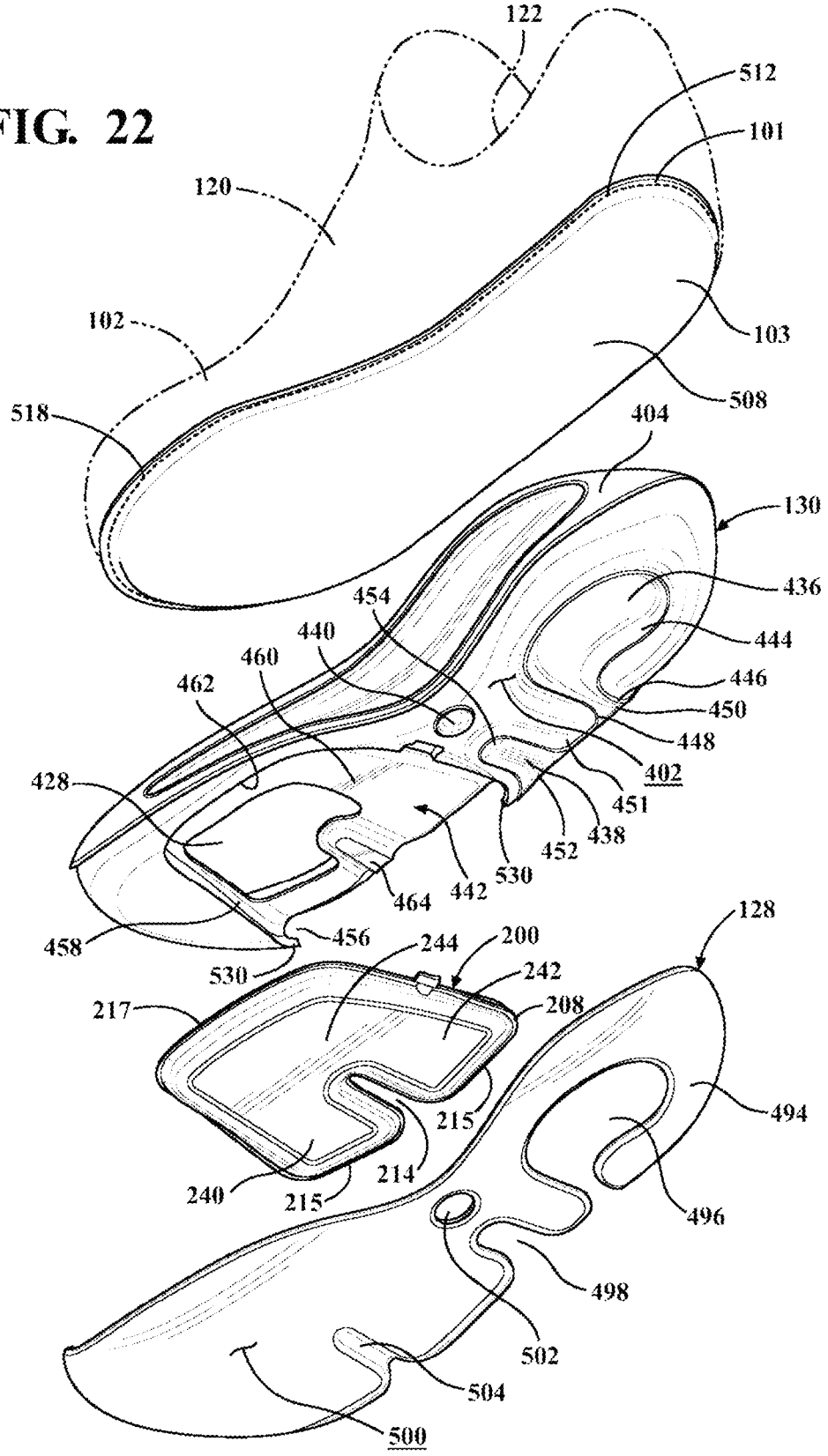

FIG. 7 a perspective view of a bladder of the article of footwear of FIG. 1;

FIG. 8 is a superior side view of the bladder of FIG. 7;

FIG. 9 is an inferior side view of the bladder of FIG. 7;

FIG. 10 is a lateral side view of the bladder of FIG. 7;

FIG. 11 is a medial side view of the bladder of FIG. 7;

FIG. 12 is an anterior side view of the bladder of FIG. 7;

FIG. 13 is a posterior side view of the bladder of FIG. 7;

FIG. 14 is a lateral side view of an alternate configuration for the bladder of FIG. 7;

FIG. 15 is a cross-sectional view of the bladder of FIG. 7, taken along line 15-15 of FIG. 9;

FIG. 16 is a superior view of a bladder in accordance with the principles of the present disclosure;

FIG. 17 is a cross-sectional view of the bladder of FIG. 16, taken along line 17-17 of FIG. 16;

FIG. 18 is a cross-sectional view of the sole structure of FIG. 1, taken along line 18-18 of FIG. 6;

FIG. 19 is a cross-sectional view of the sole structure of FIG. 1, taken along line 19-19 of FIG. 6;

FIG. 20 is a cross-sectional view of the sole structure of FIG. 1, taken along line 20-20 of FIG. 6;

FIG. 21 is a cross-sectional view of the sole structure of FIG. 1, taken along line 21-21 of FIG. 6; and FIG. 22 is a bottom exploded view of an article of footwear incorporating a sole structure in accordance with the principles of the present disclosure.

Corresponding reference numerals indicate corresponding parts throughout the drawings.

DETAILED DESCRIPTION

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (, "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a sole structure for an article of footwear including an upper is provided. The sole structure includes a midsole having a first surface opposing the upper, a second surface disposed on an opposite side of the midsole than the first surface, and an aperture formed through a thickness of the midsole and including a first opening at the first surface and a second opening at the second surface, a first fluid-filled chamber abutting the second surface of the midsole and extending over the aperture at the second opening, and a strobel attached to the upper and extending into the aperture at the first opening, the strobel opposing the first fluid-filled chamber at the aperture.

The sole structure may include one or more of the following optional features. For example, the aperture may be disposed in a forefoot region of the sole structure. Additionally or alternatively, the strobel may include a second fluid-filled chamber. The second fluid-filled chamber may extend into the aperture at the first opening. Further, the second fluid-filled chamber may abut the first fluid-filled chamber proximate to the second opening and may be attached to the first fluid-filled chamber proximate to the second opening.

In one configuration, a thickness of the second fluid-filled chamber is approximately equal to a thickness of the midsole at the aperture.

The first fluid-filled chamber may extend over the entire second opening. Additionally or alternatively, the aperture may be asymmetric.

An article of footwear may incorporate the sole structure.

In another configuration, an article of footwear is provided and includes an upper, a strobel attached to the upper, a midsole including a first surface opposing the upper, a second surface disposed on an opposite side of the midsole than the first surface, and an aperture formed through a thickness of the midsole and including a first opening at the first surface and a second opening at the second surface, and a first fluid-filled chamber abutting the second surface of the midsole and extending over the aperture at the second opening, the first fluid-filled chamber in contact with the strobel at the second opening.

The article of footwear may include one or more of the following optional features. For example, the aperture may be disposed in a forefoot region of the midsole. Additionally or alternatively, the strobel may include a second fluid-filled chamber. The second fluid-filled chamber may extend into the aperture at the first opening. Further, the second fluid-filled chamber may abut the first fluid-filled chamber proximate to the second opening and may be attached to the first fluid-filled chamber proximate to the second opening.

In one configuration, a thickness of the second fluid-filled chamber may be approximately equal to a thickness of the midsole at the aperture.

The strobel may include a web area surrounding the second fluid-filled chamber. The web area may be attached to the upper. Additionally or alternatively, the first fluid-filled chamber may extend over the entire second opening.

The details of one or more implementations of the disclosure are set forth in the accompanying drawings and the description below. Other aspects, features, and advantages will be apparent from the description, the drawings, and the claims.

Figure 2:
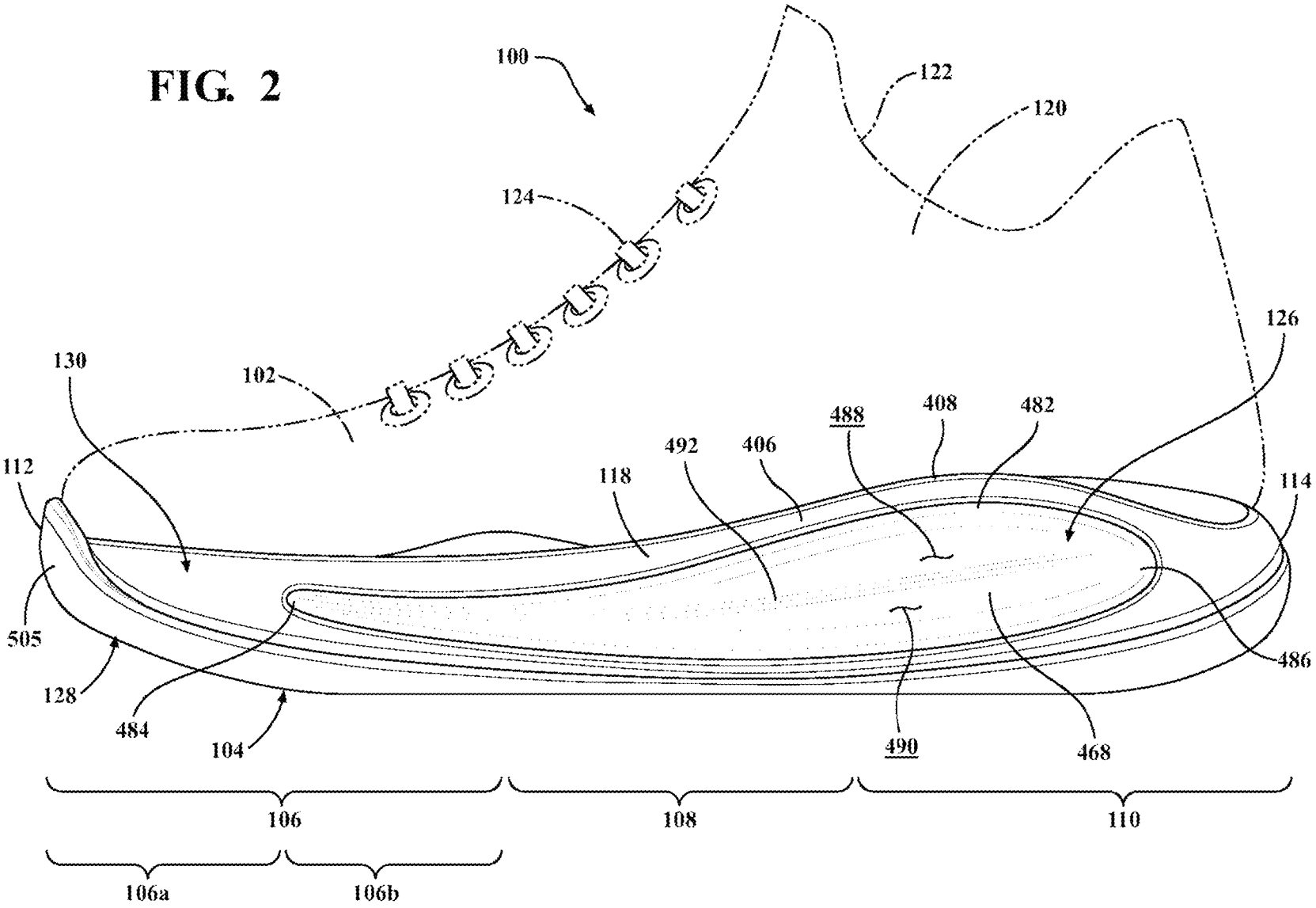
FIG. 2 is a medial side view of the article of footwear of FIG. 1.

FIGS. 1 and 2 depict an article of footwear 100 in accordance with the principles of the present disclosure. The article of footwear 100 includes an upper 102 and a sole structure 104 and may be divided into one or more regions. Referring to FIG. 2, the regions may include a forefoot region 106, a midfoot region 108, and a heel region 110. The forefoot region 106 may be subdivided into a toe portion 106*a* corresponding with phalanges, and a ball portion 106*b* associated with metatarsal bones of a foot. The midfoot region 108 may correspond with an arch area of the foot while the heel region 110 may correspond with rear portions of the foot, including a calcaneus bone. The footwear 100 may further include an anterior end 112 associated with a forward-most point of the forefoot region 106 and a posterior end 114 associated with a rearward-most point of the heel region 110. A longitudinal axis $A_F$ of the footwear 100 (FIG. 5) extends along a length of the footwear 100 from the anterior end 112 to the posterior end 114, and generally divides the footwear 100 at its widest location into a lateral side 116 and a medial side 118. Accordingly, the lateral side 116 and the medial side 118 respectively correspond with opposite sides of the footwear 100 and extend through the regions 106, 108, 110.

The upper 102 of the footwear 100 includes interior surfaces that define an interior void 120 configured to receive and secure a foot for support on the sole structure 104. The upper 102 may be formed from one or more materials that are stitched or adhesively bonded together to form the interior void 120. Suitable materials of the upper may include, but are not limited to, mesh, textiles, foam, leather, and synthetic leather. The materials may be selected and located to impart properties of durability, air-permeability, wear-resistance, flexibility, and comfort.

Figure 4:
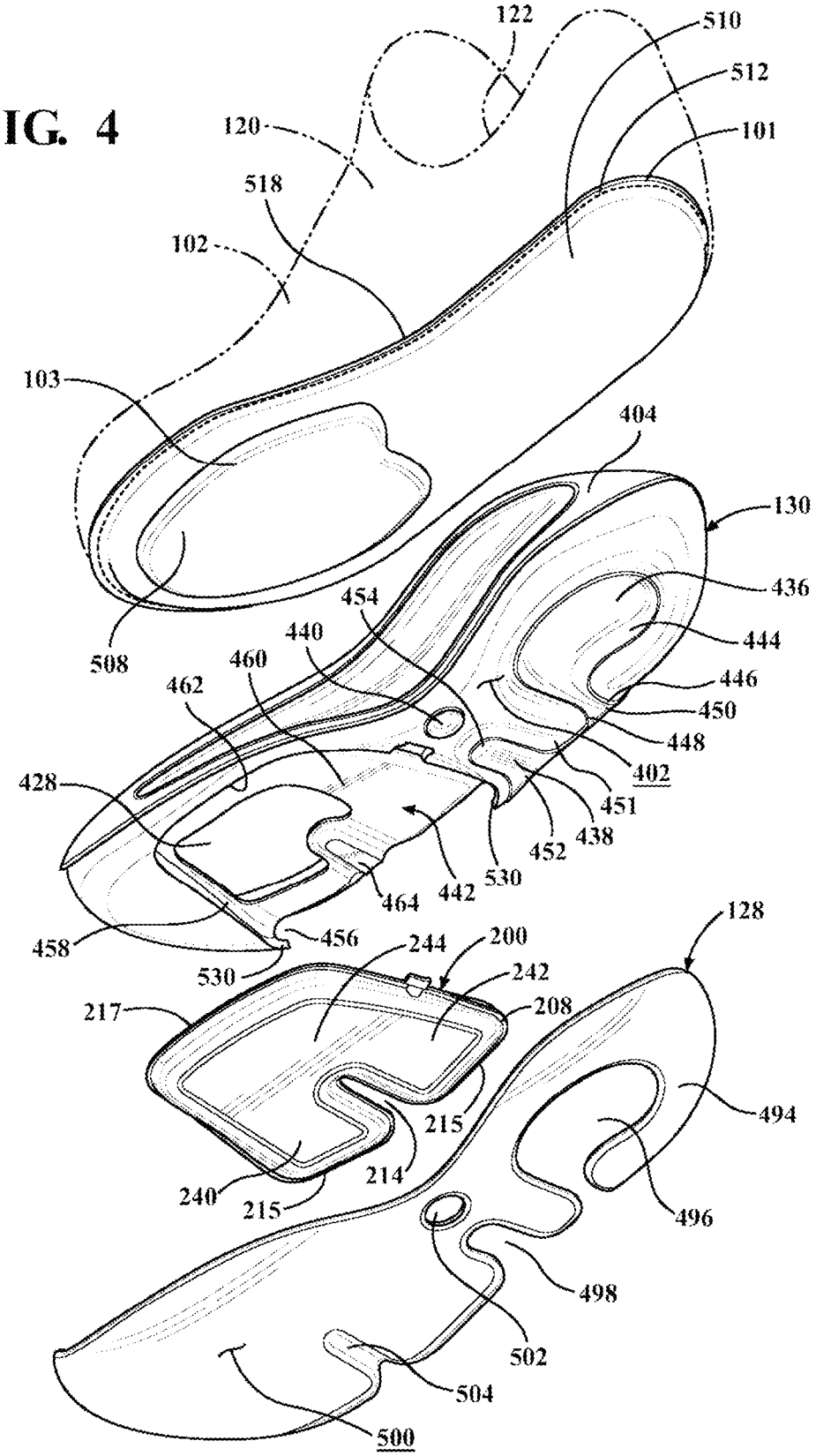
FIG. 4 is a bottom exploded view of the article of footwear of FIG. 1.

In some examples, the upper 102 includes a strobel 103 (FIG. 5) having a bottom surface opposing the sole structure 104 and an opposing top surface defining a footbed of the interior void 120. Stitching 101 and/or adhesives may secure the strobel 103 to the upper 102 around a bottom, perimeter edge of the upper 102. In one configuration, the footbed may be contoured to conform to a profile of the bottom surface (e.g., plantar) of the foot. As will be described in greater detail below, the strobel 103 may include a woven material, may be a full-length fluid-filled chamber (FIG. 22), or may include only a portion having a fluid-filled chamber (FIG. 4).

Optionally, the upper 102 may also incorporate additional layers such as an insole or sockliner (not shown) that may be received within the interior void 120 and reside on the strobel 103. The insole may be formed from a pliable material such as, for example, foam and may receive a plantar surface of the foot to enhance the comfort of the article of footwear 100 during wear. An ankle opening 122 in the heel region 110 of the upper 102 may provide access to the interior void 120. For example, the ankle opening 122 may receive a foot to secure the foot within the interior void 120 and facilitate entry and removal of the foot to and from the interior void 120.

In some examples, one or more fasteners 124 are adjustably coupled to the upper 102. The fasteners 124 can be used to adjust a fit of the interior void 120 around the foot and to accommodate entry and removal of the foot therefrom. The fasteners 124 may include laces, straps, cords, hook-and-loop, and/or any other suitable type of fastener. In some instances, the upper 102 may include a tongue portion (not shown) that extends between the interior void 120 and the fasteners 124.

Figure 3:
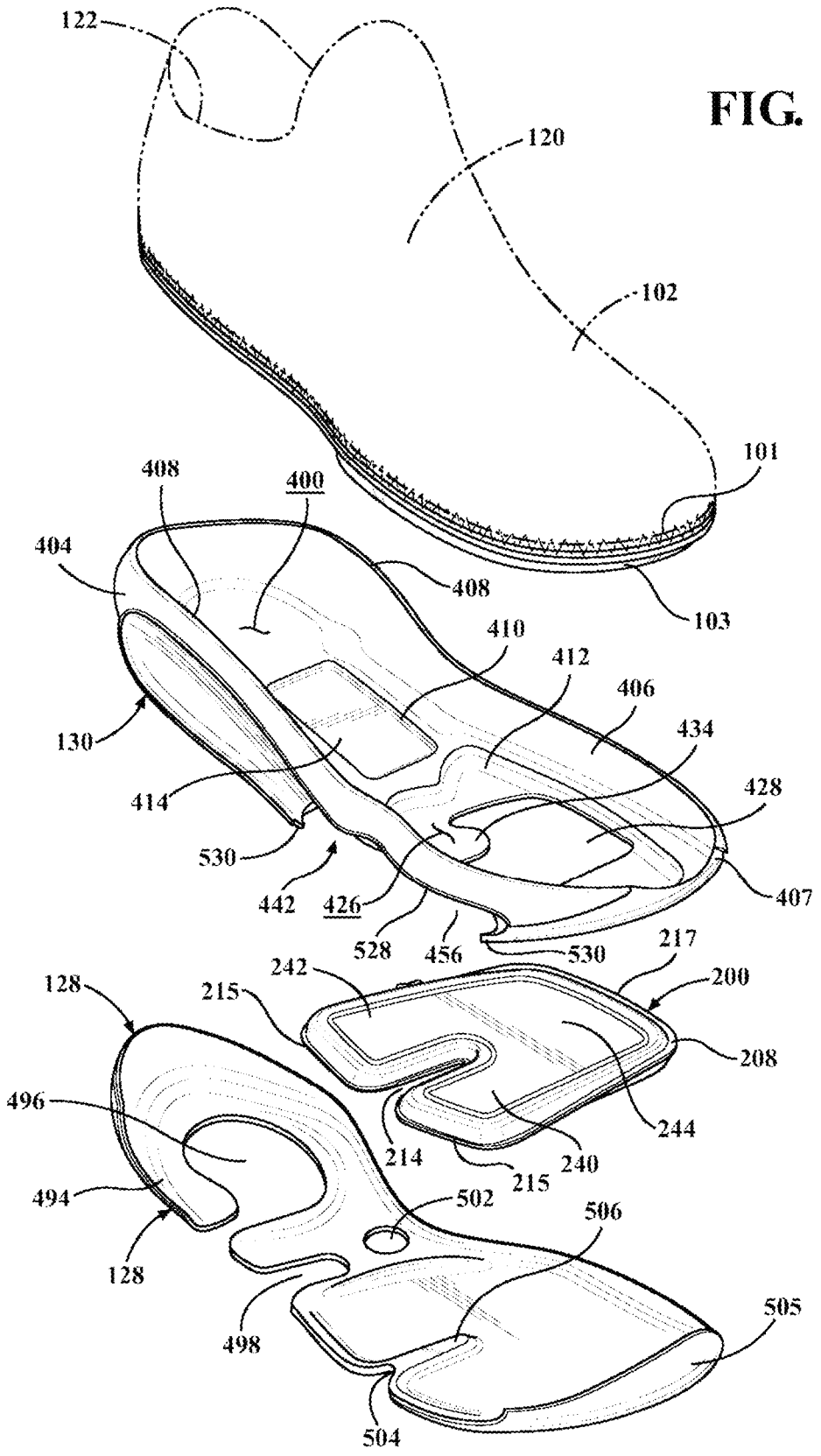
FIG. 3 is a top exploded view of the article of footwear of FIG. 1.

Referring to FIG. 1, the sole structure 104 of the article of footwear 100 includes a midsole 126 and an outsole 128. The midsole 126 provides cushioning characteristics to the sole structure 104 while the outsole 128 provides a primary ground-engaging surface of the article of footwear 100. In some examples, the midsole 126 and/or the outsole 128 can each comprise a plurality of subcomponents. For example, as shown in FIGS. 3 and 4, the midsole 126 includes a bladder 200 and a cushioning member 130 that receives the bladder 200.

FIGS. 7-15 depict the bladder 200 of the midsole 126. Referring to FIG. 15, the bladder 200 includes an opposing pair of barrier elements 202, 204 that can be joined to each other at discrete locations to define a chamber 206 and a peripheral seam 208. In the illustrated configuration, the barrier elements 202, 204 include a first, superior barrier element 202 (e.g., an "upper barrier element 202" when disposed within the midsole 126) and a second, inferior barrier element 204 (e.g., a "lower barrier element 204" when disposed within the midsole 126). While the chamber 206 is described as being formed from two barrier elements 202, 204, the chamber 206 could be formed from any suitable combination of one or more barrier layers. For example, the chamber 206 could be formed by folding a single sheet on itself and joining the folded sheet into the shape shown in FIG. 8 by welding or otherwise attaching opposing portions of the sheet to one another in the shape shown in FIG. 8 at the peripheral seam 208. As shown, the chamber 206 is generally defined as the space between the barrier elements 202, 204, while the peripheral seam 208 defines an outer periphery of the bladder 200. The peripheral seam 208 is formed by attaching opposing portions of the barrier elements 202, 204 together by welding or adhesively bonding the elements 202, 204 at the location of the peripheral seam 208. If welding the elements 202, 204 together, heat and/or pressure may be applied to the elements 202, 204 by a suitable process such as, for example, radio frequency (RF) welding to cause a material of the elements 202, 204 to flow and meld together.

As used herein, the term "barrier layer" (e.g., the barrier elements 202, 204) encompasses both monolayer and multilayer films. In some configurations, one or both of barrier elements 202, 204 are each produced (e.g., thermoformed or blow molded) from a monolayer film (a single layer). In other configurations, one or both of barrier elements 202, 204 are each produced (e.g., thermoformed or blow molded) from a multilayer film (multiple sublayers). In either instance, each layer or sublayer can have a film thickness ranging from about 0.2 micrometers to about 1 millimeter. In further configurations, the film thickness for each layer or sublayer can range from about 0.5 micrometers to about 500 micrometers. In yet further configurations, the film thickness for each layer or sublayer can range from about 1 micrometer to about 100 micrometers.

In some examples, the lower barrier element 204 may have a greater thickness than the upper barrier element 202, whereby the lower barrier element 204 is configured to provide a portion of the ground-contacting surface of the article of footwear 100.

One or both of the barrier elements 202, 204 can independently be transparent, translucent, and/or opaque. For example, the upper barrier element 202 may be transparent, while the lower barrier element 204 is opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer, and one cannot see clearly through the barrier layer at all. A translucent barrier layer falls between a transparent barrier layer and an opaque barrier layer. Light passes through a translucent layer but some of the light is scattered so that a viewer cannot see clearly through the layer.

Barrier elements 202, 204 can each be produced from an elastomeric material that includes one or more thermoplastic polymers and/or one or more cross-linkable polymers. In some instances, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, the term "polyurethane" refers to a copolymer (including oligomers) that contains a urethane group (—N(C—O)O—). These polyurethanes can contain additional groups such as ester, ether, urea, allophanate, biuret, carbodiimide, oxazolidinyl, isocynaurate, uretdione, carbonate, and the like, in addition to urethane groups. In some instances, one or more of the polyurethanes can be produced by polymerizing one or more isocyanates with one or more polyols to produce copolymer chains having (—N(C—O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some configurations, the copolymer chains are substantially free of aromatic groups.

In particular instances, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In other instances, the polymeric layer can be formed of one or more of the following: EVOH copolymers, poly(vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier elements 202, 204 may include two or more sublayers (multilayer film) such as described in U.S. Pat. Nos. 5,713,141 and 5,952,065, which are incorporated by reference herein. In examples where the barrier elements 202, 204 include two or more sublayers, examples of suitable multilayer films include microlayer films such as those disclosed in U.S. Pat. No. 6,582,786, which is incorporated by reference herein. In further examples, the barrier elements 202, 204 may each independently include alternating sublayers of one or more TPU copolymer materials and one or more EVOH copolymer materials, where the total number of sublayers in each of barrier elements 202, 204 includes at least four sublayers, at least ten sublayers, at least twenty sublayers, at least forty sublayers, and/or at least sixty sublayers.

The chamber 206 can be produced from barrier elements 202, 204 using any suitable technique, such as thermoforming (e.g., vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In some examples, the barrier elements 202, 204 can be produced by co-extrusion followed by vacuum thermoforming to produce the chamber 206, which can optionally include one or more valves (e.g., one-way valves) that allows the chamber 206 to be filled with the fluid (e.g., gas). Additional details regarding forming the chamber 206 are provided below.

The chamber 206 can be provided in a fluid-filled (e.g., as provided in the footwear 100) or in an unfilled state. The chamber 206 can be filled to include any suitable fluid, such as a gas or liquid. In an aspect, the gas can include air, nitrogen (N2), or any other suitable gas. In other instances, the chamber 206 can alternatively include other media, such as pellets, beads, ground recycled material, and the like (e.g., foamed beads and/or rubber beads). The fluid provided to the chamber 206 can result in the chamber 206 being pressurized. Alternatively, the fluid provided to the chamber 206 can be at atmospheric pressure such that the chamber 206 is not pressurized but, rather, contains a volume of fluid at atmospheric pressure.

The chamber 206 desirably has a low gas transmission rate to preserve its retained gas pressure. In some examples, the chamber 206 has a gas transmission rate for nitrogen gas that is at least about ten times lower than a nitrogen gas transmission rate for a butyl rubber layer of substantially the same dimensions. In particular instances, the chamber 206 has a nitrogen gas transmission rate of 15 cubic-centimeter/square-meter·atmosphere·day (cm3/m2·atm·day) or less for an average film thickness of 500 micrometers (based on thicknesses of barrier elements 202, 204). In further instances, the transmission rate is 10 cm3/m2·atm·day or less, 5 cm3/m2·atm·day or less, or 1 cm3/m2·atm·day or less.

In some implementations, the upper barrier element 202 and the lower barrier element 204 cooperate to define a geometry (e.g., thicknesses, width, and lengths) of the chamber 206. For example, the peripheral seam 208 may cooperate to bound and extend around the chamber 206 to seal the fluid (e.g., air) within the chamber 206. Thus, the chamber 206 is associated with an area of the bladder 200 where interior surfaces of the upper and lower barrier elements 202, 204 are separated from one another.

The space formed between opposing interior surfaces of the upper and lower barrier elements 202, 204 defines an interior void of the chamber 206. Similarly, the exterior surfaces of the upper and lower barrier elements 202, 204 define an exterior profile of the chamber 206. Accordingly, the upper and lower barrier elements 202, 204 define respective upper and lower surfaces of the bladder 200.

As shown in FIGS. 7 and 15, the chamber 206 comprises a border portion 210 (which can also be called "an accumulator portion") and an interior portion 212. The border portion 210 and the interior portion 212 are in fluid communication with one another. The border portion 210 is disposed adjacent to the peripheral seam 208 and extends inwardly toward the interior portion 212. In one configuration, the border portion 210 has a thickness TB that is greater than a thickness TI of the interior portion 212. In other configurations, the thickness of the bladder 200 is substantially the same at the border portion 210 and at the interior portion 212, as shown in FIG. 15. In this configuration, and as shown in FIG. 15, thickness TB is substantially equal to thickness TI.

When assembled within the sole structure 104, the border portion 210 of the bladder 200 (i.e., an outer, peripheral edge of the bladder 200) may be at least partially exposed along a peripheral edge of the sole structure 104. For example, as depicted in FIG. 1, the border portion 210 is exposed along the lateral side 116 of the sole structure 104.

Referring to FIG. 15, the border portion 210 of the chamber 206 has curved, outwardly facing surfaces. Namely, the outer, peripheral edge of the border portion 210 includes arcuate surfaces 211 that meet at the peripheral seam 208. As such, the border portion 210 comprises a generally D-shaped cross-sectional profile when viewed from the perspective depicted in FIG. 15. In other examples, the border portion 210 can comprise various other cross-sectional profiles (e.g., rectangular, ovular, circular, and/or other standard or non-standard geometric shapes). The interior portion 212 of the chamber 206 comprises a generally rectangular cross-sectional profile. In the depicted example, the border portion and the interior portion each have substantially uniform thicknesses and uniform shapes throughout. In other examples, the border portion and the interior portion each have non-uniform thicknesses and non-uniform shapes throughout.

Referring now to FIG. 8, the bladder 200 may include a notch 214. The notch 214 extends inwardly from a lateral edge 215 of the bladder 200 toward a medial edge 217 of the bladder 200 to form a channel in the bladder 200. The terms "medial" and "lateral" are used to designate the position of the edges 215, 217 when the bladder 200 is incorporated into the sole structure 104. The edges 215, 217, are disposed on opposite sides of the bladder 200 from one another. As such, the notch 214 extends into the bladder 200 from a first edge 215 and in a direction toward an opposite side of the bladder 200 (i.e., toward a second edge 217 formed on an opposite side of the bladder 200 than the first edge 215).

The notch 214 is positioned within the bladder 200 in an effort to improve the flexibility of the bladder 200 and, thus, improve the flexibility of the sole structure 104 and footwear 100 incorporating the bladder 200. In some instances, the notch 214 can increase the flexibility of the bladder by up to 50%. In particular instances, the notch 214 can increase the flexibility of the bladder 200 by 35-45%. The notch 214 may be aligned with the ball portion of a wearer's foot (e.g., in the metatarsal head region) and can, for example, allow the bladder 200 to articulate (e.g., flex, pivot, etc.) with the wearer's foot. In particular instances, the notch 214 may be aligned with (e.g., at least partially longitudinally overlap) the first metatarsal head of the wearer's foot. In other instances, the notch 214 may be aligned with the second metatarsal head of the wearer's foot. In other instances, the notch 214 may be aligned with the third metatarsal head of the wearer's foot. In other instances, the notch 214 may be aligned with the fourth metatarsal head of the wearer's foot. In other instances, the notch 214 may be aligned with the fifth metatarsal head of the wearer's foot.

In some examples, the notch 214 may include a substantially uniform width. In such examples, the notch 214 includes a first width WN1 adjacent to the lateral edge 215 of the bladder 200 and a second width WN2 proximate to a terminal end 219 of the notch 214. In this configuration, the widths WN1 and WN2 are approximately equal to one another such that the first width WN1 and the second width WN2 are within 3% of one another. In this manner, the notch 214 comprises a substantially "U" shape. The first width WN1 and the second width WN2 are measured between radii of curvature where the edges of the bladder 200 defining the notch 214 extend at least substantially in a medial/lateral direction. In other examples, the notch 214 may include a non-uniform width. In such examples, the first width WN1 and the second width WN2 differ by more than 3%, as shown in FIGS. 8 and 9. In these cases, the notch 214 comprises a substantially "V" or "tapered" shape. When the notch 214 is tapered, the notch 214 tapers in a direction from the lateral edge 215 toward the terminal end 219 such that the notch 214 decreases in width from the lateral edge 215 to the terminal end 219 (i.e., in a direction from the lateral edge 215 toward the medial edge 217). Such tapering can be constant, as shown in FIGS. 8 and 9, or can vary along the length of the notch 214 from the lateral edge 215 to the terminal end 219. In other instances, the notch 214 can comprise various other shapes and/or widths.

The notch 214 comprises a length LN defined as a straight-line distance from an opening of the notch 214 at the lateral edge 215 to the terminal end 219. In the event that the medial and/or lateral edges are curves, the length LN can be the distance between tangent lines intersecting the curves.

In some examples, the length LN of the notch 214 can be less than 50% of a max width Wmax of the bladder 200 (FIG. 8). In some examples, the length LN of the notch 214 can be less than 40% of the max width Wmax of the bladder 200. In some examples, the length LN of the notch 214 can be less than 30% of the max width Wmax of the bladder 200. In some examples, the length LN of the notch 214 can be less than 20% of the max width Wmax of the bladder 200. In particular examples, the length LN of the notch 214 can be within a range of 10-50% of the max width Wmax of the bladder 200. In certain examples, the length LN of the notch 214 can be within a range of 20-40% of the max width Wmax of the bladder 200.

In one configuration, the border portion 210 of the bladder 200 that defines the notch 214 can have a reduced thickness compared to other locations of the border portion 210 (e.g., the lateral edge 215 and the medial edge 217). Reducing the thickness of the border portion 210 around the notch 214 (e.g., to a thickness equal to or less than the thickness TI of the interior portion) can, for example, improve the feel of the bladder 200 under the wearer's foot.

As shown in FIGS. 8 and 9, the lateral edge 215 and the medial edge 217 are disposed on opposite sides of the bladder 200 and are spaced apart from one another by an anterior edge 222 and a posterior edge 224. The terms "anterior" and "posterior" refer to the positions of the bladder 200 when incorporated into the sole structure 104. Namely, the anterior edge 222 is disposed proximate to the anterior end 112 within the forefoot region 106 while the posterior edge 224 is disposed between the anterior edge 222 and the posterior end 114 and is located within the forefoot region 106 and the midfoot region 108. While these edges 222, 224 will be described hereinafter as being an anterior edge 222 and a posterior edge 224, these edges 222, 224 could alternatively be referred to as a third edge 222 and a fourth edge 224 when referencing the edges 222, 224 apart from the sole structure 104.

The lateral edge 215 may be disposed proximate to the lateral side 116 when incorporated into the sole structure 104 and may include a first segment 221 and a second segment 223. The first segment 221 is separated from the second segment 223 by the notch 214. Each segment 221, 223 includes a substantially straight portion extending along an axis $A_{221}$, $A_{223}$. As shown in FIG. 8, these axes $A_{221}$, $A_{223}$ are convergent with one another and are located on opposite sides of the notch 214. The first segment 221 and the second segment 223 each terminate at the notch 214. As shown, the segments 221, 223 transition into the notch 214 at a radius 225. The radius 225 associated with the first segment 221 and the radius 225 associated with the second segment 223 cooperate to define an opening to the notch 214 as well as the widest point of the notch 214.

As described above, the notch 214 may taper in a direction from the lateral edge 215 to the terminal end 219. As shown in FIGS. 8 and 9, the opening of the notch 214 is the widest point of the notch 214 and may include a different taper than the rest of the notch 214. For example, the notch 214 may taper to a greater extent at the portion of the notch 214 defined by the radii 225 as comparted to the portion of the notch 214 extending between the radii 225 and the terminal end 219.

The medial edge 217 is disposed on an opposite side of the bladder 200 than the lateral edge 215 and includes a substantially convex surface 227. The convex surface 227 may provide the medial edge 217 with a curved profile that matches or is substantially similar to a curvature of the midsole 126. Providing the medial edge 217 with a curved profile that is similar to that of the midsole 126 allows the bladder 200 to align with an outer edge of the midsole 126 and, in so doing, maximize the amount of coverage the bladder 200 provides.

The anterior edge 222 extends between and connects the first segment 221 of the lateral edge 215 and the convex surface 227 of the medial edge 217. As shown in FIGS. 8 and 9, the anterior edge 222 is connected to the first segment 221 of the lateral edge 215 by an arcuate segment 229 and is connected to the medial edge 217 by an arcuate segment 231. The anterior edge 222 includes a substantially planar portion 233 extending between and connecting the arcuate segment 229 and the arcuate segment 233. The planar portion 233 extends along an axis $A_{233}$.

The posterior edge 224 extends between the second segment 223 of the lateral edge 215 and the convex surface 227 of the medial edge 217. As shown in FIGS. 8 and 9, the posterior edge 224 is connected to the second segment 223 of the lateral edge 215 by an arcuate segment 235 and is connected to the medial edge 217 by an arcuate segment 237. The posterior edge 224 includes a substantially planar portion 239 extending between and connecting the arcuate segment 235 and the arcuate segment 237. The planar portion 239 extends along an axis $A_{239}$.

The foregoing edges 215, 217, 222, 224 provide the bladder 200 with an asymmetric shape. Namely, the bladder 200 is asymmetric about an axis extending through the center of the bladder 200 from the lateral edge 215 to the medial edge 217 and is asymmetric about an axis extending through the center of the bladder 200 from the anterior edge 222 to the posterior edge 224.

With continued reference to FIGS. 8 and 9, the axis $A_{233}$ and the axis $A_{239}$ are shown as being convergent with one another. In the configuration shown in FIG. 9, the axes $A_{233}$, $A_{239}$ extend in a direction away from one another at the lateral edge 215. The axes $A_{233}$, $A_{239}$ extend away from one another at the lateral edge 215 due to the shape of the bladder 200 on either side of the notch 214. Specifically, the bladder 200 includes a first segment 240 disposed between the notch 214 and the anterior edge 222 and a second segment 242 disposed between the notch 214 and the posterior edge 224. The first segment 240 and the second segment 242 extend from a common location 244 between the terminal end 219 of the notch 214 and the medial edge 217. The first segment 240 extends from the medial edge 217 to the first segment 221 of the lateral edge 215. Similarly, the second segment 242 extends from the medial edge 217 to the second segment 223 of the lateral edge 215. As shown, the second segment 242 may be longer than the first segment 240. The second segment 242 may be longer than the first segment 240 to allow the second segment 242 to extend from the medial side 118 of the sole structure 104 within the forefoot region 106 to the lateral side 116 of the sole structure 104 in the midfoot region 108. This way, the bladder 200 can maximize coverage to enhance cushioning and support during wear.

Referring now to FIGS. 10-14, the peripheral seam 208 of the bladder 200 can comprise a first segment 216 disposed adjacent to an inferior surface 248 of the bladder 200 defined by the second barrier element 204 and a second segment 218 disposed adjacent to a superior surface 246 of the bladder 200 defined by the first barrier element 202. The peripheral seam 208 can also include a transition segment 220 disposed between the first segment 216 and the second segment 218. As shown in FIGS. 10, 12, and 13, the first segment 216 of the peripheral seam 208 is disposed on the lateral, anterior, and posterior sides of the bladder 200. As shown in FIGS. 11-13, the second segment 218 of the peripheral seam 208 is disposed on the medial, anterior, and posterior sides of the bladder 200. As shown in FIGS. 12 and 13, the transition segment 220 of the peripheral seam 208 is disposed on the anterior and posterior sides of the bladder 200. In this manner, the peripheral seam 208 of the bladder 200 can be referred to as "a jogged seam" (e.g., the seam 208 "jogs" from the inferior surface 248 to the superior surface 246 of the bladder 200 around a periphery of the bladder 200) and extends through a majority of a thickness of the bladder 200 from the inferior surface 248 to the superior surface 246.

Configuring the bladder 200 with a jogged peripheral seam can, for example, provide functional and/or aesthetic benefits. As one example, a bladder can have one or more functional and/or aesthetical properties on a first portion of the bladder (e.g., a lateral side) and one or more different functional and/or aesthetic properties on a second portion of the bladder (e.g., a medial side), as will be described in more detail below.

The first segment 216 of the peripheral seam 208 is disposed proximate to or substantially aligned with the inferior surface 248 of the bladder 200 and is disposed on the lateral side 116 of the footwear 100. This configuration can, for example, provide the functional benefit of increased stability. Namely, locating the peripheral seam 208 proximate to the inferior surface 248 likewise positions the peripheral seam 208 proximate to the outsole 128. In so doing, the relatively rigid seam 208 (created by melding a material of the first barrier element 202 and the second barrier element 204 together) is attached to the midsole 126 proximate to a junction of the midsole 126 and the outsole 128, which allows the rigid seam 208 to act as an anchor and resist deformation of the bladder 200 during cutting or side-to-side movements. The configuration also provides an aesthetic benefit, as the first segment 216 of the peripheral seam 208 is hidden from the perspective of someone looking downwardly at the footwear 100. The first segment 216 is hidden by a material of the midsole 126 and/or a material of the outsole 128 such that only the upper barrier element 202 is visible at a periphery of the sole structure 104.

The second segment 218 of the peripheral seam 208 is disposed proximate to or substantially aligned with the superior surface 246 of the bladder 200 and is disposed on the medial side 118 of the footwear 100. This configuration can, for example, facilitate installation of the bladder 200 into the midsole 126 of the sole structure 104. For example, positioning the peripheral seam 208 proximate to or aligned with the superior surface 246 allows the lower barrier element 204 to have a reduced profile due to the material of the seam 208 being moved proximate to the top of the bladder 200. In so doing, a material of the midsole 126 and/or the outsole 128 can more easily wrap up onto the second barrier element 204 by having an increased radius and, further, can allow the outsole 128 and, thus, the sole structure 104, to have a reduced profile.

With reference to FIG. 14, an alternate configuration of the peripheral seam 208 is provided. The peripheral seam shown in FIG. 14 is identical to the peripheral seam 208 shown in FIG. 10 with the exception of the portion of the seam located within the notch 214. Accordingly, like reference numerals are used hereinafter and in drawings to identify like components while like reference numerals containing a letter extension are used to identify those components that have been modified.

In the configuration shown in FIG. 14, a bladder **200*a* is shown having a peripheral seam 208*a* that extends into the notch 214 but, rather than having the seam located proximate to the inferior surface 248 along both edges of the notch 214, as shown in FIG. 10, the peripheral seam 208*a* extends in a direction toward the superior surface 246 proximate to the radius 225 associated with the first segment 221 and the second segment 223 of the lateral edge 215. This portion of the peripheral seam 208*a* then extends along the notch 214 at an approximate midpoint of a thickness of the bladder 200*a* (i.e., substantially centrally located between the superior surface 246 and the inferior surface 248). Accordingly, the peripheral seam 208*a* extends into the notch 214 at a location that is higher or closer to the superior surface 246 when comparted to the peripheral seam 208 of the bladder 200 (FIG. 10). As shown in FIG. 14, the resulting seam 208*a* extends around a periphery of the bladder 200*a* within the notch 214 at a location that is at an approximate midpoint of a thickness of the bladder 200*a* from an opening of the notch 214 at the first segment 221, to a distal end 219*a* of the notch 214, and from the distal end 219*a* to the second segment 223**.

Extending the peripheral seam **208*a* into the notch 214 such that the peripheral seam 208*a* extends proximate to a midpoint of a thickness of the bladder 200*a* within the notch 214 facilitates compression of the bladder 200*a* by requiring less force to collapse the bladder 200*a* along the length of the notch 214 and at the terminal end 219*a* as compared to the bladder 220**.

The jogged seams 208, **208*a* provide manufacturing and weight advantages in addition to the performance advantages outlined above. Namely, the jogged seams 208, 208***a* allow for use of thinner barrier elements when compared to conventional bladders. This is due to the fact that the barrier layers are not required to have a deep draw around an entire perimeter thereof during formation of the bladder 200, 200*a*. Rather, when the seam 208, 208*a* is aligned with or substantially aligned with a surface 246, 248 of the respective barrier elements 202, 204, the draw required to form the bladder 200, 200*a* at these locations is minimal, thereby allowing for use of a thinner barrier layer during manufacturing. Further, use of relatively thinner barrier layers distributes material stretching more evenly across both barrier elements 202, 204, as compared to forming the entire border portion 210 in a single barrier layer. Alternatively, if barrier layers of typical thickness are used, the bladder 200 will be more stable and/or resilient due to use of the jogged seam 208, 208*a*, as each barrier element 202, 204 undergoes less deformation because only a portion of the layer is stretched.

In some instances, a first barrier layer can comprise one or more properties (e.g., color, opacity, translucency, thickness, material type, etc.), and a second barrier layer can comprise one or more different properties. The different barrier layers can, for example, create different performance and/or aesthetic properties. For example, a bladder with a jogged seam and barrier layers of different color can be configured such that the bladder appears to have a first color on a first portion (e.g., a lateral side) of the footwear and a second color on a second portion (e.g., a medial side) of the footwear.

In the depicted example, the transition segment 220 of the peripheral seam 208 is positioned such that it is not visible to the wearer and/or an observer when the footwear 100 is assembled. The transition segment 220 may extend along a length of the bladder 200 from a first end of the bladder 200 to a second end of the bladder 200, as shown in FIGS. 12 and 13. The transition segment 220 extends between and connects the first segment 216 and the second segment 218 and gradually increases in height from the first segment 216 to the second segment 218. In one configuration, the transition segment 220 increases in height at a constant rate between the first segment 216 and the second segment 218 such that the transition segment 220 has a substantially constant slope. In other configurations, the transition segment 220 may include a different slope between the first segment 216 and the second segment 218 for at least a portion of the length of the transition segment 220.

The bladder 200 can comprise various shapes. For example, as shown in FIG. 8, the medial and/or posterior sides of the bladder 200 can comprise an arcuate or curved shape. The lateral edge 215 can be angled or tapered from the notch 214 in the anterior-medial and/or posterior-medial directions. In other words, the bladder 200 is wider adjacent to the notch 214 than at the anterior-lateral and/or posterior-lateral corners of the bladder 200. When viewed from the superior side (e.g., FIG. 8), the bladder comprises a substantially "C" shape. In other examples, various other shapes, degrees of curvature, degrees of taper, etc. can be used.

It should be noted that, although the bladder 200 comprises a notch 214 and a jogged peripheral seam 208, a bladder can comprise any one of these features without having one or more of the others. For example, a bladder can comprise a jogged peripheral seam and not comprise a notch. As another example, a bladder can comprise a notch and not comprise a jogged peripheral seam.

In addition to being filled with a fluid, in some instances, at least a portion of a chamber of a bladder can be filled with one or more components. The filling material/components can, for example, improve the resiliency and/or durability of the bladder.

For example, referring to FIG. 15, the chamber 206 of the bladder 200 includes one or more tensile strands 226 disposed therein. In some examples, the tensile strands 226 can be referred to as tensile elements. Each tensile strand 226 can extend between an upper tensile sheet 228 and a lower tensile sheet 230. The upper tensile sheet 228 may be attached to the first barrier element 202 while the lower tensile sheet 230 may be attached to the second barrier element 204. In this manner, when the chamber 206 of the bladder 200 receives a pressurized fluid, the tensile strands 226 are placed in tension. Because the upper tensile sheet 228 is attached to the first barrier element 202 and the lower tensile sheet 230 is attached to the second barrier element 204, the tensile strands 226 retain a desired shape of the chamber 206 when pressurized fluid is injected into the chamber via a port 232.

In lieu of or in addition to the tensile strands, in some instances, a bladder can comprise a foam element disposed within a chamber of the bladder. For example, FIGS. 16 and 17 depict a bladder 300. The bladder 300 is configured similar to the bladder 200, except that the bladder 300 comprises a foam element 326 disposed in an interior portion 312 of a chamber 306 of the bladder 300 rather than having tensile strands 226 disposed in the chamber 206 like the bladder 200. Given the similarities between the bladder 200 and the bladder 300, the reference numerals of the bladder 300 correspond to similar components of the bladder 200, unless stated otherwise. Namely, one hundred (100) is added to the corresponding reference number from the bladder 200 to identify like components in the bladder 300. For example, reference numerals 302 and 304 respectively correspond to reference numerals 202 and 204 in the bladder 200.

The bladder 300 can, for example, be used with the footwear 100 in lieu of the bladder 200. As with the bladder 200, the bladder 300 can be pressurized to a pressure above ambient pressure.

The bladders 200 and 300 can be formed in various ways. Several exemplary methods are provided below with respect to the bladder 200. The bladder 300 can be formed in a similar manner.

In some examples, a bladder can be formed without tensile strands and/or a foam element disposed within the chamber. For example, in some instances, the bladder 200 can be filled with a fluid via a port (e.g., the port 232) but not have any other material added to the chamber.

In some implementations, the upper and lower barrier elements 202, 204 are formed by respective mold portions each defining various surfaces for forming depressions and pinched surfaces corresponding to locations where the peripheral seam 208 is formed when the upper barrier element 202 and the lower barrier element 204 are joined and bonded together. In some implementations, adhesive bonding joins the upper barrier element 202 and the lower barrier element 204 to form the peripheral seam 208. In other implementations, the upper barrier element 202 and the lower barrier element 204 are joined to form the peripheral seam 208 by thermal bonding. In some examples, one or both of the barrier elements 202, 204 are heated to a temperature that facilitates shaping and melding. In some examples, the barrier elements 202, 204 are heated prior to being located between their respective molds. In other examples, the mold may be heated to raise the temperature of the barrier elements 202, 204. In some implementations, a molding process used to form the chamber 206 incorporates vacuum ports within mold portions to remove air such that the upper and lower barrier elements 202, 204 are drawn into contact with respective mold portions. In other implementations, fluids such as air may be injected into areas between the upper and lower barrier elements 202, 204 such that the resulting increase in pressure causes the barrier elements 202, 204 to engage with surfaces of their respective mold portions.

The cushioning member 130 and the bladder 200 of the midsole 126 can be configured to mate in various ways. For example, in some instances, the cushioning member 130 can be over-molded onto the bladder 200 such that the bladder 200 is at least partially embedded or encapsulated by the cushioning member 130. In such instances, a top surface of the cushioning member 130 defines a profile of the footbed and may be contoured to correspond to a shape of the foot. Further, a material of the cushioning member 130 may completely or partially fill the notch 214, as will be described in greater detail below.

The cushioning member 130 includes a top surface 400 opposing the upper 102, a bottom surface 402 located on an opposite side of the cushioning member 130 than the top surface 400 and opposing the outsole 128, and a sidewall 404 extending between and connecting the top surface 400 and the bottom surface 402. The top surface 400 is bounded by a flange 406 extending in a direction away from the top surface 400 and in a direction toward the upper 102. The flange 406 includes an undulating profile that generally increases in a direction extending from the anterior end 112 toward the posterior end 114. As shown in FIG. 3, the flange 406 includes an apex 408 that is spaced apart from the posterior end 114 and is generally aligned with a heel of a wearer when donning the footwear 100. The flange 406 extends continuously and uninterrupted around an outer perimeter of the cushioning member 103 from the lateral side 116 proximate to the anterior end 112, around the posterior end 114, to the medial side 118 proximate to the anterior end 112. The flange 406 is interrupted at the anterior end 112 to define gap 407 that receives a portion of the outsole 128, as will be described in greater detail below.

The top surface 400 includes a first recess 410 located within the midfoot region 108 and a second recess 412 located in the forefoot region 106. The first recess 410 includes a generally rectangular shape and may receive a modulator plate 414 therein. The modulator plate 414 provides the cushioning member 130 and, thus, the midsole 126 with a degree of rigidity, as the modulator plate 414 is relatively rigid and includes a greater rigidity than the cushioning member 130. The second recess 412 is located in the forefoot region 106 and includes a first arcuate edge 416 extending along the lateral side 116, a second arcuate edge 418 extending along the medial side 118, and a third arcuate edge 420 extending in a direction between the lateral side 116 and the medial side 118 and connecting the first arcuate edge 416 and the second arcuate edge 418. The third arcuate edge 420 includes an undulating profile defining a first pocket 422 proximate to the lateral side 116 and a second pocket 424 proximate to the medial side 118. As shown, the second pocket 424 extends in a direction toward the posterior end 114 to a greater extent than the first pocket 422 in an effort to maximize underfoot cushioning. As will be described in more detail below, the second recess 412 is shaped and sized to receive a portion of the strobel 103. When the strobel 103 is formed form a fluid-filled chamber, the strobel 103 is positioned within and substantially fills the second recess 412, thereby maximizing underfoot cushioning in the forefoot region 106.

The second recess 412 includes a surface 426 that is recessed from the upper surface 400. The distance between the upper surface 400 and the surface 426 of the second recess 412 is shown in FIG. 18 at $T_{412}$.

Figure 5:
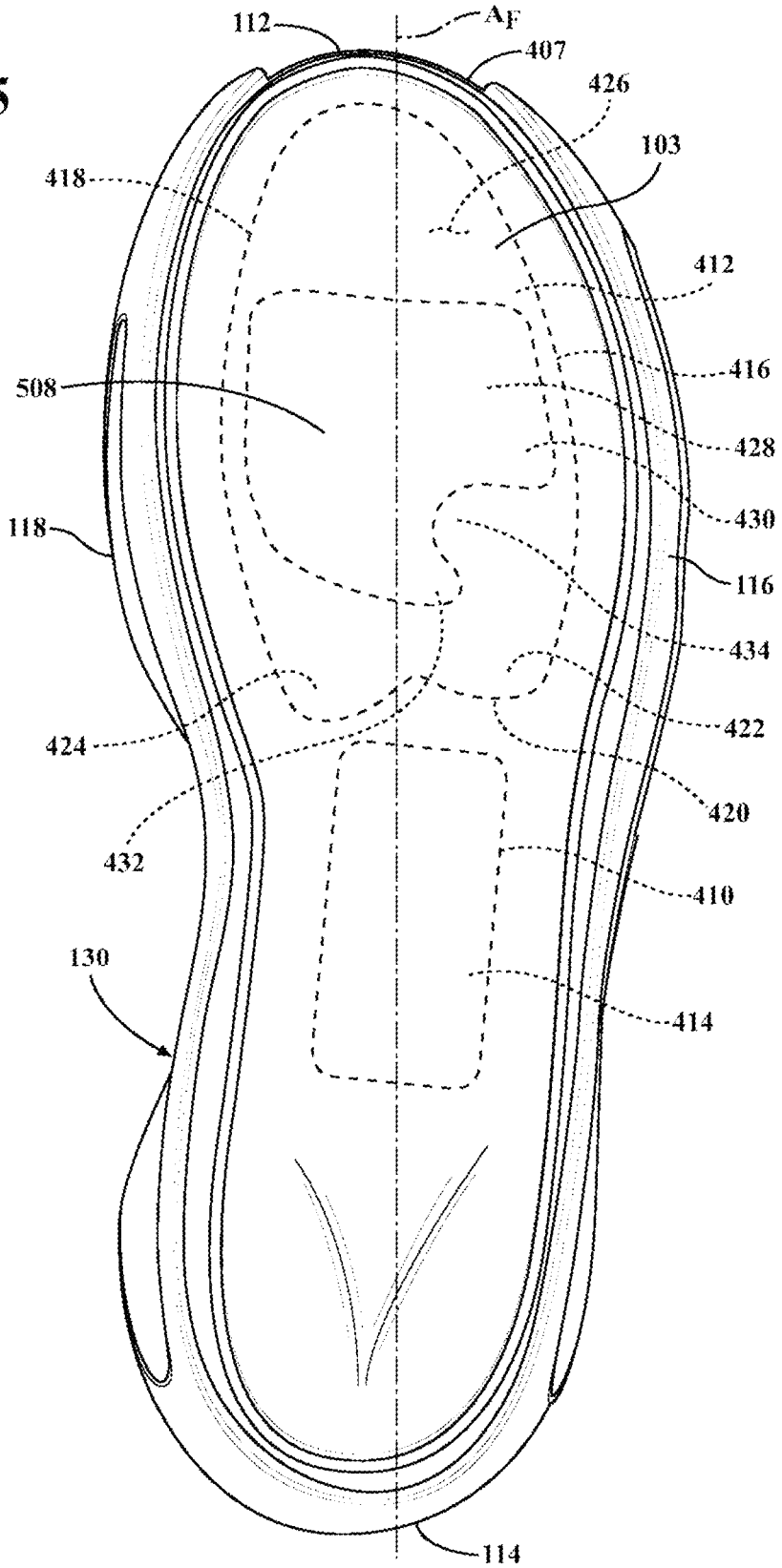
FIG. 5 is a top view of the sole structure of FIG. 1.

An aperture 428 is formed through a thickness of the cushioning member 130 at the second recess 412. As shown in FIG. 5, the aperture 428 is located within the forefoot region 106 and is formed through the cushioning member 130 at the second recess 412. The aperture 428 is positioned within and is surrounded by the first arcuate edge 416, the second arcuate edge 418, and the third arcuate edge 420. Further, the aperture 428 includes a different shape than the second recess 412 and includes a first pocket 430 and a second pocket 432 that cooperate to define a peninsula 434 formed by a material of the cushioning member 130 that extends into the aperture 428.

The bottom surface 402 includes a recess 436 located in the heel region 110, a channel 438 extending into a material of the cushioning member 130 from the lateral side 116, a depression 440, and a pocket 442. The recess 436 is defined by an arcuate wall 444 that extends from a first end 446 at the lateral side 116 in a direction toward the medial side 118 to a second end 448 located at the lateral side 116. The first end 446 opposes and is spaced apart from the second end 448 at the lateral side 116 to define an opening 450 to the recess 436 at the lateral side 116. As shown in FIG. 4, the recess 436 extends into a material of the cushioning member 130 in a direction toward the top surface 400 and is in fluid communication with the opening 450 at the lateral side 116.

The channel 438 is disposed between the recess 436 and the anterior end 112 of the sole structure 104 and includes an opening 452 disposed at the lateral side 116 and a rounded, distal end 454 disposed proximate to a midpoint of the cushioning member 130. The channel 438 extends along a longitudinal axis between the opening 452 and the distal end 454. As shown in FIG. 6, the opening 452 widens in a direction extending in a direction from the medial side 118 to the lateral side 116. As such, the opening 452 tapers in a direction from the lateral side 116 toward the medial side 118. The opening 452 is disposed adjacent to the opening 450 of the recess 436 at the lateral side 116 but is spaced apart from the opening 450 by a projection 451 of the cushioning member 130.

The depression 440 includes a substantially circular shape and is disposed between the channel 438 and the medial side 118. As shown in FIG. 6, the depression 440 is substantially aligned with the distal end 454 of the channel 438.

The pocket 442 is disposed between the channel 438 and the anterior end 112 of the sole structure 104 and includes an opening 456 disposed at the lateral side 116. The opening 456 extends along a length of the sole structure 104 within the forefoot region 106 and, in one configuration, extends along a majority of the forefoot region 106. The pocket 442 further includes a first portion 458 extending from the opening 456 in a direction toward the medial side 118 and a second portion 460 extending from the opening 456 in a direction toward the medial side 118. The first portion 458 and the second portion 460 extend along respective longitudinal axes and terminate at an arcuate end wall 462 defining a portion of the pocket 442 proximate to the medial side 118. The longitudinal axes of the first portion 458 and the second portion 460 are convergent with one another and converge in a direction from the lateral side 116 toward the medial side 118.

The pocket 442 further includes a projection 464 that extends from the lateral side 116 proximate to the opening 456 and in a direction toward the medial side 118. The projection 464 extends into the aperture 428 and forms the peninsula 434 located between the first pocket 430 and the second pocket 432.

With particular reference to FIGS. 1-4, the sidewall 404 of the cushioning member 130 is shown as including a first recess 466 formed into the sidewall 404 at the lateral side 116 and a second recess 468 formed into the sidewall 404 at the medial side 118. The first recess 466 extends along the sidewall 404 from the heel region 110 to the forefoot region 106 and generally tapers from an apex 470 to a first distal end 472 located in the forefoot region 106 to a second distal end 474 located in the heel region 110. Additionally, the first recess 466 includes a first opening 476 receiving a portion of the bladder 200 and a second opening 478 disposed between the first opening 476 and the posterior end 114 of the sole structure 104 and receiving a portion of the bladder 200. The first opening 476 and the second opening 478 expose the lateral edges 215 of the bladder 200 when the bladder 200 is inserted into the pocket 442. As shown in FIG. 1, the first opening 476 is spaced apart and separated from the second opening 478 by the projection 464 of the cushioning member 130. The first recess 466 includes a peak 480 at a location between the first opening 476 and the second opening 478. The peak 480 is substantially vertically aligned with the projection 464, as shown in FIG. 1.

The second recess 468 extends along the sidewall 404 from the heel region 110 to the forefoot region 106 and generally tapers from an apex 482 to a first distal end 484 located in the forefoot region 106 to a second distal end 486 located in the heel region 110. As shown in FIGS. 1 and 2, the first recess 466 and the second recess 468 each includes a greatest height (i.e., in a direction measured from the outsole 128 toward the upper 102) in the heel region 110. Providing the sidewall 404 with the recesses 466, 468 allows the cushioning member 130 to more easily compress when subjected to a load during a walking or running movement, thereby allowing the cushioning member 103 and, thus, the sole structure 104 to absorb forces during wear. Further, providing the recesses 466, 468 with a greatest height in the heel region 110 further aids in absorbing forces during a walking or running movement, as such movements typically experience the greatest loads during heel strike (i.e., when the heel region 110 contacts a ground surface during forward movements).

As shown in FIGS. 18-21, the first recess 466 and the second recess 468 are recessed into the sidewall 404 at the lateral side 116 and the medial side 118, respectively. As such, the recesses 466, 468 extend into the cushioning member 130 in a direction toward a center of the sole structure 104 and in a direction toward one another. The recesses 466, 468 provide the sidewall 404 with a concavity at both the lateral side 116 and the medial side 118 that extends along a length of the cushioning member 130 from the heel region 110 to the forefoot region 106. For example, and as shown in FIG. 21, the recesses 466, 468 may include an upper surface 488 extending in a direction away from the upper 102 and toward the outsole 128 and a lower surface 490 extending in a direction toward the upper 102 and away from the outsole 128. The upper surface 488 and the lower surface 490 may meet at a junction 492 that defines a depth of the respective recess 466, 468.

As described above, the cushioning member 130 is formed of a resilient polymeric material, such as foam or rubber, to impart properties of cushioning, responsiveness, and energy distribution to the foot of the wearer. Example resilient polymeric materials for the cushioning member 130 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some instances, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further examples, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further examples, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further examples, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further examples, the one or more polymers may include one or more polyamide copolymers (e.g., polyamide-polyether copolymers) and/or one or more polyurethanes (e.g., crosslinked polyurethanes and/or thermoplastic polyurethanes). Examples of suitable polyurethanes include those discussed above for barrier elements 202, 204. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some instances, the foamed polymeric material may be a crosslinked foamed material. In these examples, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened, and the molded foam article is removed from the mold.

As mentioned above, the outsole 128 (see, e.g., FIGS. 1 and 4) is the primary ground-engaging surface of the footwear 100. Although shown schematically as a relatively smooth surface for purposes of illustration, the outsole 128 can include various traction-enhancing elements. For example, an outsole can include grooves, lugs, ribs, spikes, cleats, etc. The outsole can, in some instances, be relatively uniform across the footwear. In other instances, the outsole can comprise various segments with different materials and/or traction-enhancing elements. In addition to being disposed on the inferior surface of the footwear, in some examples, the outsole can be disposed on one or more other surfaces. For example, an outsole can comprise a toe cap and/or a heel cap configured to protect ends of the footwear.

The outsole 128 can be formed of resilient materials that impart properties of abrasion resistance and traction to the sole structure 104. One or more of the outsole segments may be formed of a first material having a higher durometer than the others of the outsole segments. For example, one segment may be formed of a rubber material having a first durometer, while another segment is formed of a foam material having a second durometer, less than the first durometer.

The outsole 128 extends continuously from the heel region 110 to the forefoot region 106 and includes a first segment 494 extending around the heel region 110 from the lateral side 116 to the medial side 118. The first segment 494 extends around the recess 436 of the cushioning member 130 and likewise includes an aperture 496 to expose and substantially surround the recess 436. The outsole 128 additionally includes a channel 498 aligned with the channel 438 of the cushioning member 130. The channel 498 surrounds and exposes the channel 498 at a ground-engaging surface 500 of the sole structure 104 defined by the outsole 128.

The outsole 128 additionally includes an aperture 502 located adjacent to the channel 498. The aperture 502 is aligned with the depression 440 of the cushioning element 130 when the outsole 128 is attached to the cushioning element 130. Accordingly, the aperture 502 exposes the depression 440 when the outsole 128 is attached to the cushioning element 130. A groove 504 is formed into the outsole 128 in an area between the channel 498 and the anterior end 112 of the sole structure 104. The groove 504 is aligned with the projection 464 of the cushioning element 130 when the outsole 128 is attached to the cushioning element 130. As such, the groove 504 is disposed between the first segment 240 and the second segment 242 of the bladder 200 when the bladder 200 is received within the pocket 442 of the cushioning element 130. The groove 504 facilitates bending of the sole structure 104 during walking and running movements.

As shown in FIG. 3, the groove 504 causes the outsole 128 to include a raised portion 506 located on an opposite side of the outsole 128 than the ground-engaging surface 500. The raised portion 506 extends in a direction toward the upper 102 and is attached to the projection 464 between the first segment 240 of the bladder 200 and the second segment 242 of the bladder 200. The outsole 128 may additionally include a forward-most portion 505 that extends within the gap 407 of the cushioning element 120 to provide a degree of protection to the anterior end 112 of the sole structure 104.

With particular reference to FIGS. 4 and 18-22, the strobel 103 may include a fluid-filled chamber 508. The fluid-filled chamber 508 may be a so-called full-length fluid-filled chamber that extends substantially the entire length of the sole structure 104 from the anterior end 112 to the posterior end 114, as shown in FIG. 22. Alternatively, the fluid-filled chamber 508 may include one or more discrete locations that are filled with fluid and other locations that form a web area 510, as shown in FIG. 4. Regardless of whether the strobel 103 is a full-length fluid-filled chamber (FIG. 22) or includes a discrete location containing fluid (FIG. 4), the strobel 103 includes a flange 512 that is attached to the upper 102. Specifically, the flange 512 may be an outer edge of the web area 510 where opposing barrier elements 514, 516 are joined to one another or may define an outer perimeter of the strobel 103 where the barrier elements 514, 516 are joined to one another. The barrier elements 514, 516 may be identical to the barrier elements 202, 204 forming the bladder 200 and may be joined to one another at the web area 510 and the flange 512 in the manner described above with respect to the bladder 200. The strobel 103 may be attached to the upper 102 by a mechanical fastener such as stitching 518 and/or via an adhesive. Finally, the fluid-filled chamber 508 may be pressurized and/or may include a tensile element 520 having tensile strands 522 extending between an upper tensile sheet 524 and a lower tensile sheet 526. The tensile strands 522, upper tensile sheet 524, and lower tensile sheet 526 may be identical to the tensile strands 226, upper tensile sheet 228, and lower tensile sheet 230, respectively, described above. The only difference between the tensile strands 522 and the tensile strands 226 is that the tensile strands 522 are shorter in length than the tensile strands 226, as the overall thickness of the fluid-filled chamber 502 is less than that of the bladder 200.

While the strobel 103 may include a fluid-filled chamber 508 that is positioned at discrete locations of the strobel 103 or could include a full-length fluid-filled chamber 508 (FIG. 22), the strobel 103 will be described hereinafter and shown in the drawings as including a discretely located fluid-filled chamber 508, as shown in FIG. 4. Further, while the fluid-filled chamber 508 of the strobel 103 may be pressurized and/or include a tensile element 520, the fluid-filled chamber 508 of the strobel 103 will be described hereinafter and shown in the drawings as being pressurized and as including a tensile element 520.

The discretely located fluid-filled chamber 508 of the strobel 103 is located in the forefoot region 106 and includes a shape that mates with the shape of the aperture 428. As such, when the strobel 103 is attached to the upper 102 and the upper 102 is attached to the midsole 126, the fluid-filled chamber 508 extends into the aperture 428 and is in contact with the bladder 200. Specifically, the lower barrier element 516 of the fluid-filled chamber 508 opposes and is attached to the upper barrier element 202 of the bladder 200. In one configuration, the barrier element 516 of the fluid-filled chamber 508 is bonded to the upper barrier element 202 of the bladder 200 by a suitable adhesive. In other configurations, the barrier element 516 of the fluid-filled chamber 508 opposes and is in contact with the upper barrier element 202 of the bladder 200 but is not attached to the upper barrier element 202.

The strobel 103 is attached to the upper 102 via stitching 518 at an outer perimeter of the strobel 103. Specifically, the stitching 518 extends through the strobel 103 at the flange 512, as shown in FIGS. 18-21. The stitching 518 extends through the flange 512, which is created by melding or otherwise bonding the material of the barrier elements 514, 516 together. Accordingly, the stitching 518 extends through a portion of the strobel 103 that does not contain fluid. Further, in the case of the configuration shown in FIG. 4, the flange 518 is part of the larger web area 510 that extends around the fluid-filled chamber 508 and from the fluid-filled chamber 508 to the anterior end 112, to the posterior end 114, to the lateral side 116, and to the medial side 118. While the portion of the strobel 103 extending from the fluid-filled chamber 508 to the anterior end 112, to the posterior end 114, to the lateral side 116, and to the medial side 118 is described and shown as being formed from a web area 510 of the fluid-filled chamber 508, any one or more of these areas (i.e., from the fluid-filled chamber 508 to the anterior end 112, to the posterior end 114, to the lateral side 116, and to the medial side 118) could be formed from a conventional strobel material. A conventional strobel material is a fabric material having a greater hardness than a material forming the fluid-filled chamber 508.

Once assembled, the bladder 200 is received within the pocket 442 of the cushioning element 130 such that the first portion 240 of the bladder 200 is received by the first portion 458 of the pocket 442 and the second portion 242 of the bladder 200 is received by the second portion 460 of the pocket 442. The bladder 200 is positioned within the pocket 442 such that the lateral edges 215 oppose and are visible at the opening 456. In this position, the projection 464 extends into the notch 214 between the first portion 240 of the bladder 200 and the second portion 242 of the bladder 200. Further, the groove 504 of the outsole 128 extends up and places the outsole 128 in contact with the projection 464 in the area between the first portion 240 of the bladder 200 and the second portion 242 of the bladder 200. The foregoing construction provides the sole structure 104 with the ability to cushion a foot during wear while allowing the sole structure 104 to bend during walking and running movements. Specifically, the notch 214—in combination with the projection 464 and the groove 504—allows the bladder 200 to provide cushioning while simultaneously allowing the sole structure 104 to bend in an area between the first portion 240 of the bladder 200 and the second portion 242 of the bladder 200.

As described above, the bladder 200 includes a jogged peripheral seam 208. The jogged peripheral seam 208 allows the seam 208 to be located proximate to and hidden by the outsole 128 once installed in the cushioning element 130 (FIG. 20). As such, only the upper barrier element 202 of the bladder 200 is visible at the lateral side 116. Further, because the seam 208 is absent in the area proximate to a junction of the upper barrier element 202 and the bottom surface 402 (FIG. 20) is free from a seam, the cushioning element 130 may be recessed from the lateral edge 215 by a distance D. Further, a portion of the cushioning element 130 defining the opening 456 can include an undulating top edge 528 as well as undulating and wrapped side edges 530. These edges 528, 530 can have undulations without concern for exposing a portion of the seam 208, as the seam 208 is entirely hidden by the outsole 128.

In the foregoing examples, the bladders 200, 200*a*, 300 serve to provide the article of footwear 100 with support and cushioning properties. The bladders 200, 200*a*, 300 may include a notch 214 or a depression 414 to facilitate bending of the bladders 200, 200*a*, 300 during use. Further, the bladders 200, 200*a*, 300 include a jogged peripheral seam 208-208*f* that provides the bladders 200, 200*a*, 300 with stability and improved aesthetics simultaneously. The bladders 200, 200*a*, 300 in combination with the other components of the midsole 126 and the outsole 128 provide the article of footwear 100 with cushioning and responsiveness during wear.

The following Clauses provide an exemplary configuration for a sole structure for an article of footwear and an article of footwear described above.

Clause 1. A sole structure for an article of footwear including an upper, the sole structure comprising a midsole including a first surface opposing the upper, a second surface disposed on an opposite side of the midsole than the first surface, and an aperture formed through a thickness of the midsole and including a first opening at the first surface and a second opening at the second surface, a first fluid-filled chamber abutting the second surface of the midsole and extending over the aperture at the second opening, and a strobel attached to the upper and extending into the aperture at the first opening, the strobel opposing the first fluid-filled chamber at the aperture.

Clause 2. The sole structure of Clause 1, wherein the aperture is disposed in a forefoot region of the sole structure.

Clause 3. The sole structure of any of the preceding Clauses, wherein the strobel includes a second fluid-filled chamber.

Clause 4. The sole structure of Clause 3, wherein the second fluid-filled chamber extends into the aperture at the first opening.

Clause 5. The sole structure of Clause 4, wherein the second fluid-filled chamber abuts the first fluid-filled chamber proximate to the second opening.

Clause 6. The sole structure of Clause 4, wherein the second fluid-filled chamber is attached to the first fluid-filled chamber proximate to the second opening.

Clause 7. The sole structure of any of Clauses 4-6, wherein a thickness of the second fluid-filled chamber is approximately equal to a thickness of the midsole at the aperture.

Clause 8. The sole structure of any of the preceding Clauses, wherein the first fluid-filled chamber extends over the entire second opening.

Clause 9. The sole structure of any of the preceding Clauses, wherein the aperture is asymmetric.

Clause 10. An article of footwear incorporating the sole structure of any of the preceding Clauses.

Clause 11. An article of footwear comprising an upper, a strobel attached to the upper, a midsole including a first surface opposing the upper, a second surface disposed on an opposite side of the midsole than the first surface, and an aperture formed through a thickness of the midsole and including a first opening at the first surface and a second opening at the second surface, and a first fluid-filled chamber abutting the second surface of the midsole and extending over the aperture at the second opening, the first fluid-filled chamber in contact with the strobel at the second opening.

Clause 12. The article of footwear of Clause 11, wherein the aperture is disposed in a forefoot region of the midsole.

Clause 13. The article of footwear of any of the preceding Clauses, wherein the strobel includes a second fluid-filled chamber.

Clause 14. The article of footwear of Clause 13, wherein the second fluid-filled chamber extends into the aperture at the first opening.

Clause 15. The article of footwear of Clause 14, wherein the second fluid-filled chamber abuts the first fluid-filled chamber proximate to the second opening.

Clause 16. The article of footwear of Clause 14, wherein the second fluid-filled chamber is attached to the first fluid-filled chamber proximate to the second opening.

Clause 17. The article of footwear of any of Clauses 14-16, wherein a thickness of the second fluid-filled chamber is approximately equal to a thickness of the midsole at the aperture.

Clause 18. The article of footwear of Clause 14, wherein the strobel includes a web area surrounding the second fluid-filled chamber.

Clause 19. The article of footwear of Clause 18, wherein the web area is attached to the upper.

Clause 20. The article of footwear of any of the preceding Clauses, wherein the first fluid-filled chamber extends over the entire second opening.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear including an upper, the sole structure comprising:

a midsole including a first surface configured to oppose the upper, a second surface disposed on an opposite side of the midsole than the first surface, and an aperture formed through a thickness of the midsole and including a first opening at the first surface and a second opening at the second surface;

a first fluid-filled chamber abutting the second surface of the midsole and extending over the aperture at the second opening; and a strobel being a single, unitary body configured to be attached to the upper and extending into the aperture at the first opening, the strobel opposing the first fluid-filled chamber at the aperture.

2. The sole structure of claim 1, wherein the aperture is disposed in a forefoot region of the sole structure.

3. The sole structure of claim 1, wherein the strobel includes a second fluid-filled chamber.

4. The sole structure of claim 3, wherein the second fluid-filled chamber extends into the aperture at the first opening.

5. The sole structure of claim 4, wherein the second fluid-filled chamber abuts the first fluid-filled chamber proximate to the second opening.

6. The sole structure of claim 4, wherein the second fluid-filled chamber is attached to the first fluid-filled chamber proximate to the second opening.

7. The sole structure of claim 4, wherein a thickness of the second fluid-filled chamber is approximately equal to a thickness of the midsole at the aperture.

8. The sole structure of claim 1, wherein the first fluid-filled chamber extends over the entire second opening.

9. The sole structure of claim 1, wherein the aperture is asymmetric.

10. An article of footwear incorporating the sole structure of claim 1.

11. An article of footwear comprising:

an upper;

a strobel being a single, unitary body attached to the upper;

a midsole including a first surface opposing the upper, a second surface disposed on an opposite side of the midsole than the first surface, and an aperture formed through a thickness of the midsole and including a first opening at the first surface and a second opening at the second surface; and a first fluid-filled chamber abutting the second surface of the midsole and extending over the aperture at the second opening, the first fluid-filled chamber in contact with the strobel at the second opening.

12. The article of footwear of claim 11, wherein the aperture is disposed in a forefoot region of the midsole.

13. The article of footwear of claim 11, wherein the strobel includes a second fluid-filled chamber.

14. The article of footwear of claim 13, wherein the second fluid-filled chamber extends into the aperture at the first opening.

15. The article of footwear of claim 14, wherein the second fluid-filled chamber abuts the first fluid-filled chamber proximate to the second opening.

16. The article of footwear of claim 14, wherein the second fluid-filled chamber is attached to the first fluid-filled chamber proximate to the second opening.

17. The article of footwear of claim 14, wherein a thickness of the second fluid-filled chamber is approximately equal to a thickness of the midsole at the aperture.

18. The article of footwear of claim 14, wherein the strobel includes a web area surrounding the second fluid-filled chamber.

19. The article of footwear of claim 18, wherein the web area is attached to the upper.

20. The article of footwear of claim 11, wherein the first fluid-filled chamber extends over the entire second opening.

* * * * *